US008160462B2

(12) United States Patent
Shoji et al.

(10) Patent No.: US 8,160,462 B2
(45) Date of Patent: Apr. 17, 2012

(54) IMAGE FORMING APPARATUS HAVING A TRANSPORT STATUS DETECTION UNIT

(75) Inventors: Yutaka Shoji, Tokyo (JP); Junji Shirakawa, Tokyo (JP); Takayuki Muneyasu, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 923 days.

(21) Appl. No.: 12/222,323

(22) Filed: Aug. 7, 2008

(65) Prior Publication Data

US 2009/0041485 A1 Feb. 12, 2009

(30) Foreign Application Priority Data

Aug. 7, 2007 (JP) ..... 2007-205821
Aug. 21, 2007 (JP) ..... 2007-214872
Jun. 20, 2008 (JP) ..... 2008-161190

(51) Int. Cl.
*G03G 15/00* (2006.01)

(52) U.S. Cl. ..... 399/21; 399/23; 399/405

(58) Field of Classification Search ..... 399/21, 399/23, 405

See application file for complete search history.

(56) References Cited

U.S. PATENT DOCUMENTS 6,347,196 B1 * 2/2002 Kawabata et al. ..... 399/16

FOREIGN PATENT DOCUMENTS

| | | | | |
|---|---|---|---|---|
| JP | 56-008163 | | | 1/1981 |
| JP | 02-257158 | | | 10/1990 |
| JP | 03018540 | A | * | 1/1991 |
| JP | 07261608 | A | * | 10/1995 |
| JP | 09124208 | A | * | 5/1997 |
| JP | 2000-118116 | | | 4/2000 |
| JP | 2002-268304 | | | 9/2002 |
| JP | 2002268304 | A | * | 9/2002 |
| JP | 2003012214 | A | * | 1/2003 |
| JP | 2004175482 | A | * | 6/2004 |
| JP | 2006167974 | A | * | 6/2006 |
| JP | 2007-022722 | | | 2/2007 |
| JP | 2007148169 | A | * | 6/2007 |

* cited by examiner

*Primary Examiner* — Daniel J Colilla

(74) *Attorney, Agent, or Firm* — Harness, Dickey & Pierce, P.L.C.

(57) ABSTRACT

A disclosed image forming apparatus includes a transport unit configured to transport a recording medium along a transport path, a transport status detection unit disposed on the transport path and configured to detect a transport status of the recording medium, a control unit configured to control transport by the transport unit according to the transport status of the recording medium detected by the transport status detection unit, and a container unit configured to hold the recording medium. If the transport status detection unit detects a delay in transporting the recording medium, the control unit controls the transport unit to discharge the recording medium or another recording medium in the transport path into the container unit.

14 Claims, 16 Drawing Sheets

RELATED ART

RELATED ART

IMAGE FORMING APPARATUS HAVING A TRANSPORT STATUS DETECTION UNIT

BACKGROUND OF THE INVENTION

1. Field of the Invention

The present invention relates to an image forming apparatus that is configured to, even if a transport error of a recording sheet occurs, continue transporting a recording sheet without stopping the apparatus and discharge the recording sheet remaining in the apparatus, and is provided with a container unit that holds the discharged recording sheet.

2. Description of the Related Art

Image forming apparatuses are known that include a discharge unit for discharging a recording sheet remaining in the image forming apparatuses when a recording sheet becomes jammed.

Japanese Patent Laid-Open Publication No. 2-257158 (Patent Document 1) discloses an image forming apparatus having a double-sided printing device that performs double-sided printing by reversing and re-feeding recording sheets. This image forming apparatus includes a discharge unit that discharges a recording sheet remaining in the image forming apparatus body upon occurrence of a jam.

Japanese Patent Laid-Open Publication No. 2002-268304 (Patent Document 2) discloses a copying machine that identifies a recording sheet having both sides printed and remaining in the apparatus body upon occurrence of a jam and, if the identified recording sheet is not the jammed sheet, discharges the identified, recording sheet. More specifically, the copying machine of Patent Document 1 performs double-sided printing while circulating plural recording sheets in a transport path. If a paper jam occurs in the transport path, the copying machine determines whether to discharge a recording sheet based on recording sheet discharge destination information (information indicating whether a recording sheet is to be discharged out of the machine body or to be transported to a reverse path) and position information indicating the position of the recording sheet in the transport path. If the recording sheet is determined to be discharged and if the recording sheet is determined not to be a jammed sheet based on paper jam information of the recording sheet, the copying machine discharges the recording sheet. This prevents the effective (printed) recording sheet from being wasted.

Japanese Patent Laid-Open Publication No. 56-8163 (Patent Document 3) discloses a recorder that detects the status of a recording sheet in a transport path such as warping and skewing and, if the status is not allowable, guides the recording sheet in a direction different from the feeding direction to remove the recording sheet from the transport path, thereby preventing a jam.

A detailed description of the image forming apparatus of Patent Document 1 is given below.

FIG. 15 illustrates the image forming apparatus (laser printer) of Patent Document 1. This apparatus includes, as integral parts, an image forming apparatus body 1 and a double-sided printing device 2. Referring to FIG. 15, image formation is performed using a usual electrophotographic process. More specifically, a recording sheet fed from a feed tray 1A, 1B, or 1C is transported to a photoreceptor 4 by feed rollers 2A, 2B, or 2C and registration rollers 3. Then processes such as charging, exposure, development, transfer, and fixing are performed by a charger 5, an optical unit 6, a developing unit 7, and a transfer charger 8, a fixing unit 9, etc., so that an image is formed. The recording sheet with one side printed is discharged from the fixing unit 9 to a discharge tray 10 or the double-sided printing device 2. Whether to discharge the recording sheet to the discharge tray 10 or to the double-sided printing device 2 is selected according to switching control of discharge rollers 11 and a switching claw 12. For discharging the recording sheets to the double-sided printing device 2, the recording sheets are transported to a transport path including reverse rollers 13 by controlling the switching claw 12. Then the recording sheets are switched back one by one to a sheet transport path b by controlling the reverse rollers 13 and the reverse claw 14. The recording sheet with one side printed is thus reversed and transported by feed rollers 15 to the registration rollers 3 to have the other side printed. It is to be noted that the units performing the image forming process are driven by a main motor 16.

Referring to FIG. 16, in this image forming apparatus, a transport direction switching unit (switching claw 18) is disposed over a recording sheet inlet 17. The switching claw 18 switches the transport direction between the discharge direction and the direction of a reverse transport path toward the double-sided printing device 2. If a jam occurs in the double-sided printing device 2, a recording sheet remaining in the image forming apparatus body 1 is discharged into a container basket 20 via an opening 19.

In this image forming apparatus, in the case of printing a large number of sheets at a time, recording sheets are sequentially fed from the large capacity feed tray 1C, and plural (three or four) recording sheets are transported simultaneously in the entire transport path, for example. In this case, the first, second, and third recording sheets are sequentially fed from the feed tray 1C into the image forming apparatus body 1 to form images on the front sides of the recording sheets. After the front side of the third sheet is printed, the first recording sheet is re-fed from the double-sided printing device 2 to have its back side printed. Then, the fourth recording sheet is newly fed to have its front side printed. That is, in this case, printing is performed on the front side of the first recording sheet, the front side of the second recording sheet, the front side of the third recording sheet, the back side of the first recording sheet, the front side of the fourth recording sheet, the back side of the second recording sheet, . . . , in this order. In this manner, printing is performed alternately on the front side of a recording sheet and the back side of another recording sheet.

Assume that, in the above described case, when the back side of the first recording sheet is printed but the front side of the fourth recording sheet is not yet printed, the third recording sheet with the front side printed becomes jammed in the transport path b. In such a case, the main motor 16 is stopped. Then, the transport system of the image forming apparatus body 1 is driven to discharge the unprinted fourth recording sheet remaining in the image forming apparatus body 1 (for example, remaining in front of the fixing unit 9 at the time of occurrence of the jam) into the inlet 17. Then the main motor 16 is restarted to print the back side of the second recording sheet (for example, the recording sheet remaining in front of the photoreceptor 4 at the time of occurrence of the jam) having the front side already printed.

As described above, in the image forming apparatus of Patent Document 1, if a recording sheet becomes jammed in the transport path b in the double-sided printing device 2, an unprinted recording sheet in the image forming apparatus is discharged. A recording sheet with the front side printed is transported to a position where printing is performed to have its back side printed. That is, if a jam occurs, a recording sheet with one side printed proceeds to have the other side printed, while the unprinted recording sheet is discharged for reuse.

Only the jammed recording sheet needs to be removed by a user, and therefore the recovery process can be performed quickly.

However, none of the above Patent Documents teaches of suggests a technique for continuing transporting recording sheets, including a recording sheet causing a transport error, remaining in the apparatus to discharge the recording sheets out of the apparatus.

More specifically, Patent Document 1 aims to prevent a recording sheet from being wasted when a jam occurs in the apparatus. For this aim, the image forming apparatus of Patent Document 1 discharges a recording sheet circulating in the apparatus without performing any further printing operation or discharges after printing the back side depending on the printed state of the recording sheet. However, the image forming apparatus does not transport the jammed sheet or a recording sheet whose path is blocked by the jammed sheet.

Similarly, Patent Document 2 aims to prevent an effective (successfully recorded) recording sheet from being wasted, and only discusses how to discharge the effective recording sheet that is not jammed upon occurrence of a jam.

Patent Document 3 aims to prevent a recording sheet from being jammed in a transport path and only discusses quick removal of a warped or a skewed recording sheet from the transport path.

Meanwhile, users who print a large number of sheets at a speed of, e.g., about 90 sheets per minute demand not only a high printing speed but also reducing the time required to perform a recovery process from a transport error of a recording sheet.

SUMMARY OF THE INVENTION

In view of the foregoing, the present invention is directed toward providing an image forming apparatus that, if a detected transport error of a recording sheet is a minor transport error, does not stop the apparatus but continues transporting recording sheets, including the recording sheet causing the transport error, as if the recording sheets were transported normally and thus discharges the recording sheets remaining in the apparatus, thereby facilitating a recovery process of the apparatus and reducing the total time to perform a series of printing operations.

According to an embodiment of the present invention, there is provided an image forming apparatus that comprises a transport unit configured to transport a recording medium along a transport path, a transport status detection unit disposed on the transport path and configured to detect a transport status of the recording medium, a control unit configured to control transport by the transport unit according to the transport status of the recording medium detected by the transport status detection unit, and a container unit configured to hold the recording medium. If the transport status detection unit detects a delay in transporting the recording medium, the control unit controls the transport unit to discharge the recording medium or another recording medium in the transport path into the container unit.

According to another embodiment of the present invention, there is provided an image forming apparatus that comprises a recording medium feed unit configured to feed a recording medium into a predetermined transport path, a transport unit configured to transport the recording medium fed by the recording medium feed unit along the transport path, a transport status detection unit disposed on the transport path and configured to detect a transport status of the recording medium, a control unit configured to control operations of the recording medium feed unit, the transport unit, and the transport status detection unit, and a container unit configured to hold the recording medium. The control unit controls, according to a detection result by the transport status detection unit, feeding of another recording medium by the recording medium feed unit and transport of the recording medium by the transport unit to discharge the recording medium and still another recording medium present in the transport path into the container unit.

According to an aspect of the present invention, if a minor transport error occurs, a recording medium present in an image forming apparatus is discharged into a predetermined container unit without stopping a transport unit. It is therefore possible to easily restore operations of the image forming apparatus from an error condition and to reduce the total time to perform a series of printing operations.

DETAILED DESCRIPTION OF THE PREFERRED EMBODIMENT

The following describes preferred embodiments of the present invention with reference to the accompanying drawings.

Figure 1:
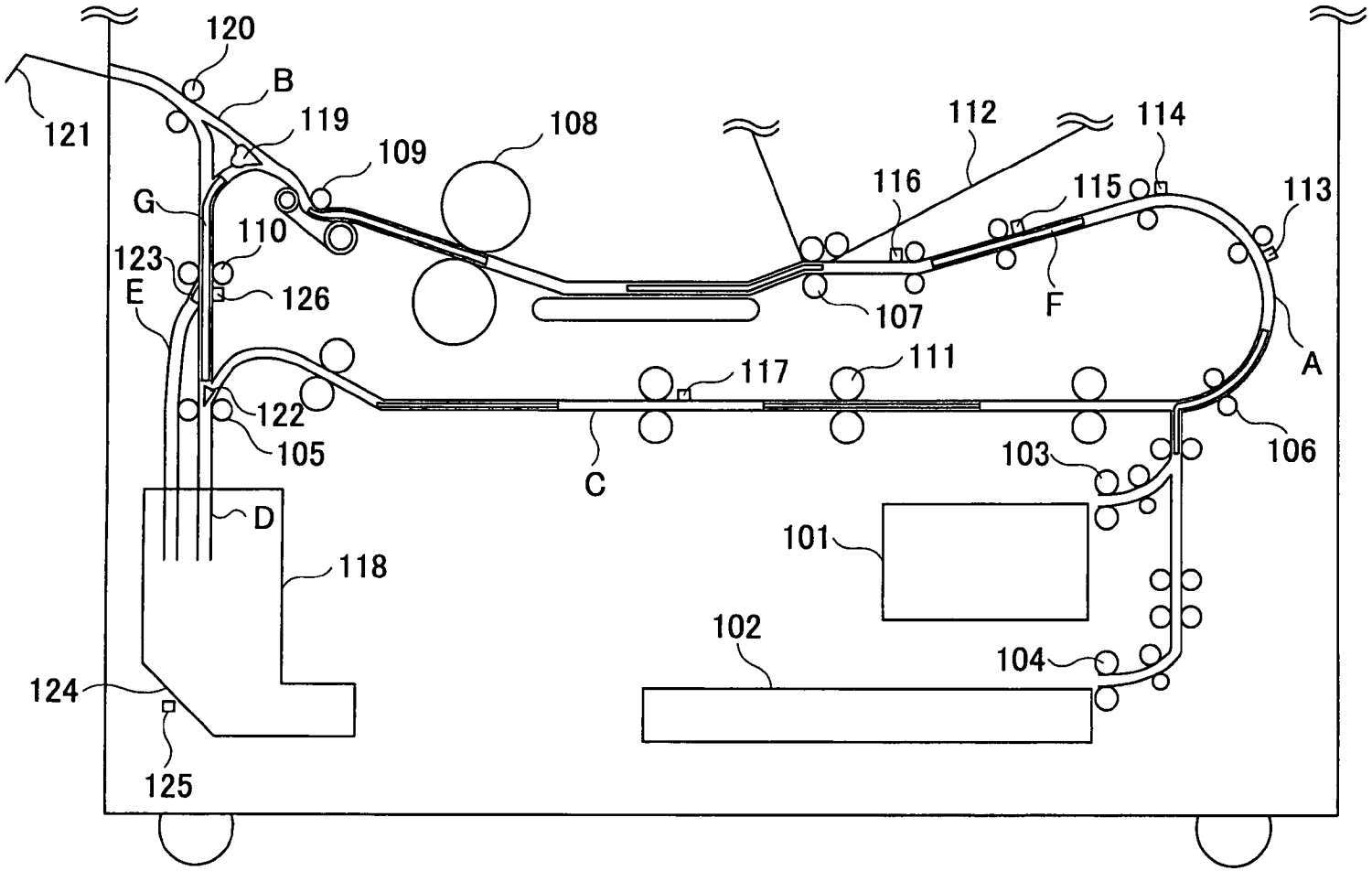
FIG. 1 is a schematic diagram illustrating an image forming apparatus according to an embodiment of the present invention.

FIG. 1 illustrates an image forming apparatus according to an embodiment of the present invention. In FIG. 1, reference numerals 101 and 102 denote feed trays; 103 and 104 denote feed rollers; 105 denotes reverse rollers; 106 denotes transport rollers; 107 denotes transfer rollers, 108 denotes fixing rollers; 109 denotes a transport roller; 110 denotes flip rollers; 111 denotes transport rollers; 112 denotes a transfer belt, 113-117 denote sensors; 118 denotes a discharge tray; 119 denotes a switching claw; 120 denotes discharge rollers; 121 denotes a discharge tray; 122 and 123 denote switching claws; 124 denotes a beveled surface of the discharge tray 118; and 125 and 126 denote sensors. Paths for transporting recording sheet include transport path A, a single-sided printing path B, a double-sided printing path C, a reverse path D, and a discharge path E. FIG. 1 shows seven recording sheets circulating in the recording sheet transport paths A-E inside the image forming apparatus for purposes of clarification of features of the embodiment of the present invention. For example, F and G denote the recording sheets.

Figure 15:
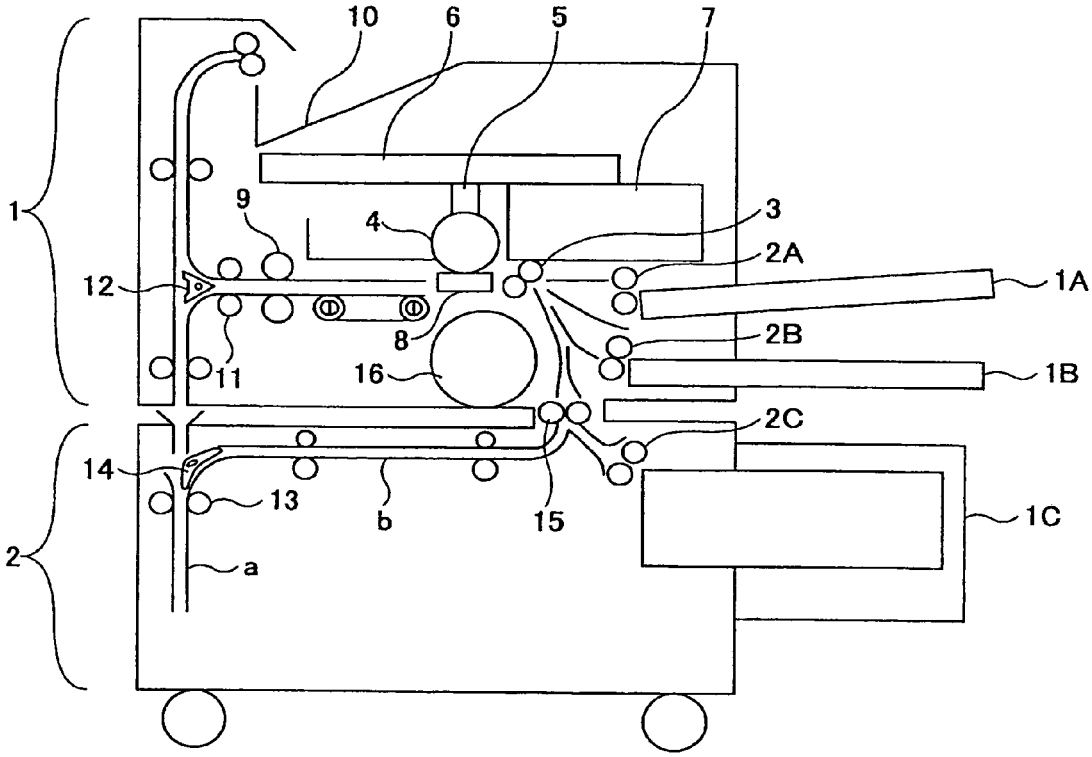
FIG. 15 is a schematic configuration diagram illustrating a related-art image forming apparatus.
Figure 16:
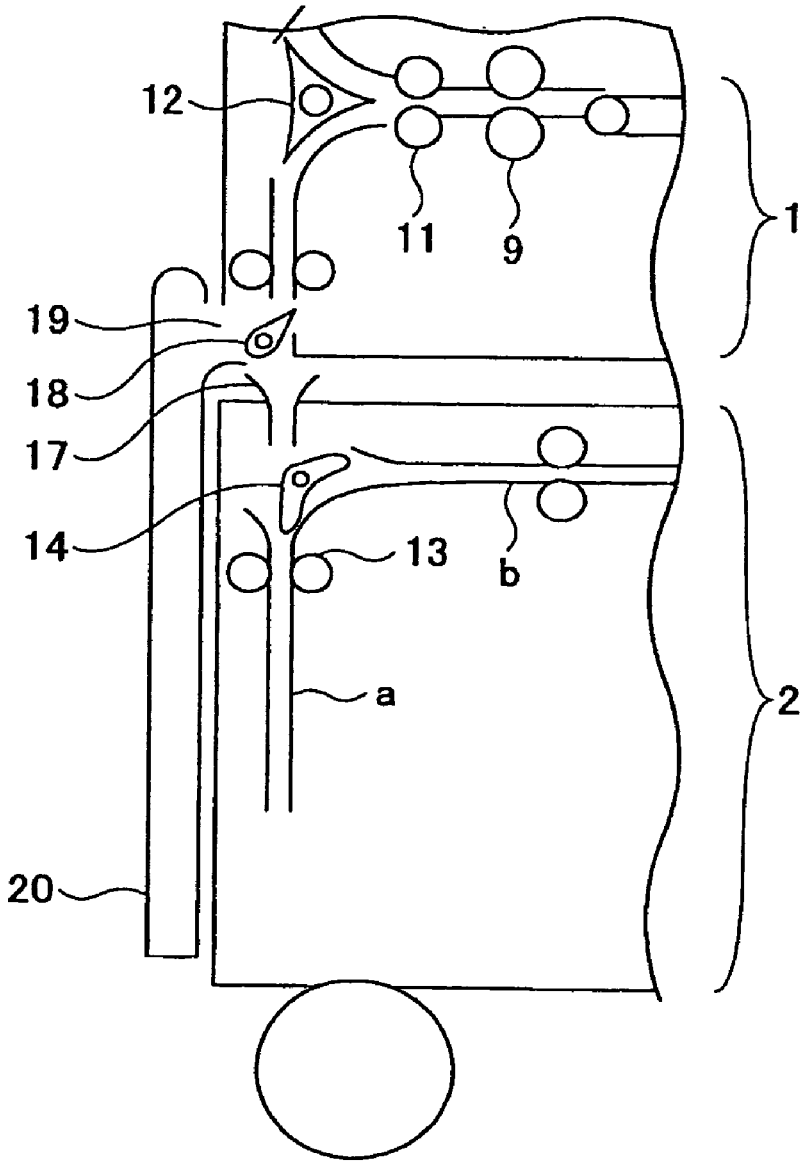
FIG. 16 is a schematic diagram illustrating a discharge section of a related-art image forming apparatus.

In FIG. 1, a recording sheet is fed from a feed tray 101 or 102. The fed recording sheet is transported via the feed rollers 103 or 104 into the sheet transport path A in the counter clockwise direction. The transport path A is a circular path, in which the front side of the fed recording sheet is printed using the image formation process and then the recording sheet is reversed by the reverse rollers 105 and returns to the image forming unit to have the back side printed. That is, the transport path A is a circular path, in which the recording sheet passes through the transport rollers 106, the transfer rollers 107, the fixing rollers 108, the transport roller 109, the flip rollers 110, the transport rollers 111, etc., to return to the transport rollers 106. An image is formed in the transport path A. An image formation system of this image forming apparatus is equivalent to an image forming system of a commonly known image forming apparatus. That is, similar to the one shown in FIG. 15, an image is formed using a usual process including charging, exposure, development, transfer, and fixing. Illustration of charging, exposure, and developing units is omitted in FIG. 1. In FIG. 1, the transfer rollers 107 form a part of a transfer unit and are configured to transfer a visible image, which is formed on the transfer belt 112 by the developing unit (not shown), onto the recording sheet. The fixing rollers 108 form a part of a fixing unit.

In such an image forming apparatus, a transport error of a recording sheet is inevitable. Transport errors include a so-called jam, which is a situation where a recording sheet is folded like an accordion or wound around a roller; non-arrival, which is a situation where a recording sheet does not reach a predetermined position in the image forming apparatus at a predetermined timing; and stay, which is a situation where a recording sheet remains in the same transport position in the image forming apparatus even when it is the timing for the recording sheet to be transported. In the case where a jam occurs, the apparatus needs to be stopped immediately. On the other hand, in the case where non-arrival or stay occurs, because non-arrival or stay does not immediately cause a failure in the apparatus if the period for which the non-arrival or the stay continues is less than a predetermined period (that is, if a sheet is transported and detected within a predetermined period of time after the sheet becomes in the non-arrival status or the stay status and thus the non-arrival or the stay is cleared), the apparatus does not necessarily need to be stopped immediately for manual removal of the recording sheet. This situation can be considered as a minor transport error.

Plural sensors 113-117 for detecting a transport status of a recording sheet are disposed on the transport path A. These sensors detect non-arrival and stay of a recording sheet. For example, the transfer timing sensor 116 is used for counting a transfer timing for a transfer unit in the subsequent step. If a leading edge of a recording sheet onto which an image is to be transferred is not detected at a predetermined timing by the sensor 116, the recording sheet is determined not to have arrived. This determination is made by monitoring, for example, the time when the leading edge of the recording sheet is detected by the other sensor 115, the time when the recording sheet is fed by the feed rollers 103, and the time when the leading edge of the recording sheet is detected by the transfer timing sensor 116. If the trailing edge of the recording sheet is not detected after a predetermine time following the detection of the leading edge (if the presence of the recording sheet is continued to be detected when the recording sheet is supposed to have passed through the sensor 116 and absence of the recording sheet of the sensor 116 is supposed to be detect), the recording sheet is determined to stay in the same place.

Similar to the transfer timing sensor 116, the other sensors 113 through 115 and 117 have a function of detecting non-arrival and stay of the recording sheet. The installation positions and the number of the sensors are appropriately determined and do not limit the scope of the present invention.

The sensor 114 also detects multi-feeding. That is, the multi-feeding sensor 114 detects plural stacked sheets being transported together. If multi-feeding is detected, a transport error is determined to have occurred. The sensor 115 also detects skew. That is, the skew sensor 115 detects a skew of a recording sheet (skew of a recording sheet with respect to the transport direction). If a skew greater than a predetermined angle is detected, the skew is determined to be an overskew, which is considered as a transport error.

The installation positions and the number of the multi-feeding sensor 114 and the skew sensor 115 may be appropriately determined.

In this embodiment, if a recording sheet is determined not to have arrived or determined to stay in the same place, feeding of recording sheets from the feed trays 101 and 102 is stopped while continuing driving the rollers (e.g., the rollers 105-111) of the transport system, thereby discharging all the recording sheets remaining in the transport path A into the discharge tray 118. Details of non-arrival and stay and details of operations to be performed when non-arrival or stay occurs are described below. The installation position and shape of the discharge tray 118 are not limited to those disclosed in the above description and may be modified without departing from the scope of the present invention.

A recording sheet that has undergone a fixing process by the fixing rollers 108 takes one of two paths, namely the single-sided printing path B and the double-sided printing path C. The single-sided printing path B extends from the transport roller 109 to the discharge rollers 120. The double-sided printing path C extends from the transport roller 109, via the flip rollers 110, the reverse rollers 105, by which the recording sheet is switched back, to the transport rollers 111. The switching between the single-sided printing path B and the double-sided printing path C is performed by controlling the switching claw 119. If single-sided printing is selected, the recording sheet passes through the single-sided printing path B and is discharged into the discharge tray 121 by the discharge rollers 120. If the case of reversing the recording sheet to be discharged upside down for the convenience of a user who picks up the discharged recording sheet although single-sided printing is selected, the recording sheet passes through the reverse path D (extending from the transport roller 109 to the reverse rollers 105 via the flip rollers 110), is switched back by the reverse roller 105, passes through the flip rollers 110 again, and is discharged into the discharge tray 121. On the other hand, if double-sided printing is selected, the recording sheet passes through the reverse path D, is switched back by the reverse rollers 105, and passes through the double-sided printing path C, so that the recording sheet is fed again toward the image forming device to have its back side printed. Whether to return the recording sheet that has been switched back by the reverse rollers 105 toward the flip rollers 110 or to guide it to the double-sided printing path C can be switched by controlling the switching claw 122.

The discharge tray 118 disposed under the reverse rollers 105 is opened to at least a discharge port of the discharge path E and a discharge port of the reverse path D passing through the reverse rollers 105. The discharge path E is formed by controlling the switching claw 123 and extends from the flip rollers 110 to the discharge tray 118. Although the discharge tray 118 is used when discharging the recording sheets remaining in the transport path A upon occurrence of a minor transport error (described below), the above-described configuration allows the recording sheets to be discharged from both the discharge path E and the reverse path D into the discharge tray 118. In the case of discharging a recording sheet from the discharge path E, the recording sheet that has been guided to the discharge path E by the switching claw 123 free-falls into and is held in the discharge tray 118. In an alternative embodiment, the recording sheet may pass through the reverse rollers 105 and be guided from the reverse path D directly to the discharge tray 118 without providing the switching claw 123 and the discharge path E. In this case, the reverse path D can be used also as a discharge path and the reverse rollers 105 are controlled such that the recording sheet is discharged into the discharged tray 118 with a drive force of the reverse rollers 105.

The recording sheet detection sensor 125 is provided on the beveled surface of the discharge tray 118. The recording sheet detection sensor 125 detects the presence of a recording sheet. If the presence of a recording sheet is detected, the presence of the recording sheet is reported to a user. The beveled surface 124 is provided in order to smoothly stack the discharged recording sheets and in order to ensure detection of the recording sheet. The presence of the recording sheet may be reported, for example, by turning on a warning lamp or by displaying the presence of the recording sheet on a display panel of the image forming apparatus. If, for example, a recording sheet is not removed and remains in the discharge tray 118, the image forming apparatus may not recover from the error and be prevented from returning to a usable condition.

Figure 2:
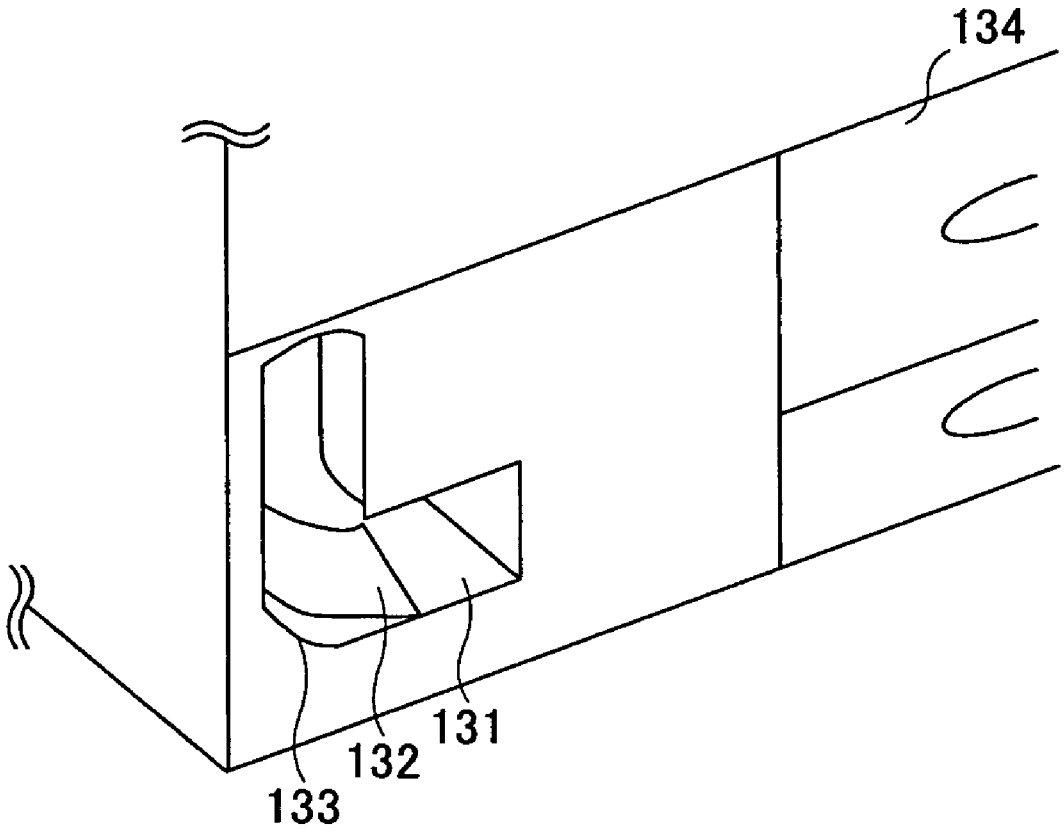
FIG. 2 is a perspective view illustrating a container unit of an image forming apparatus according to an embodiment.

The discharge tray 118 may literally be in the shape of a removable tray that is provided as a part separate from the image forming apparatus body or may be formed by cutting out a part of the casing of the image forming apparatus to form a space having a function similar to a tray (function for storing the discharged recording sheets). FIG. 2 shows an example of a discharge tray formed by cutting out a part of an image forming apparatus such as one shown in FIG. 1.

In FIG. 2, reference numeral 131 denotes a discharge port; 132 denotes a recording sheet; 133 denotes a beveled surface; and 134 denotes a feed cassette. FIG. 2 shows the recording sheet 132 being discharged into the discharge port 131. The discharge port 131 includes the beveled surface 133 similar to the beveled surface 124 shown in FIG. 1.

Figure 3:
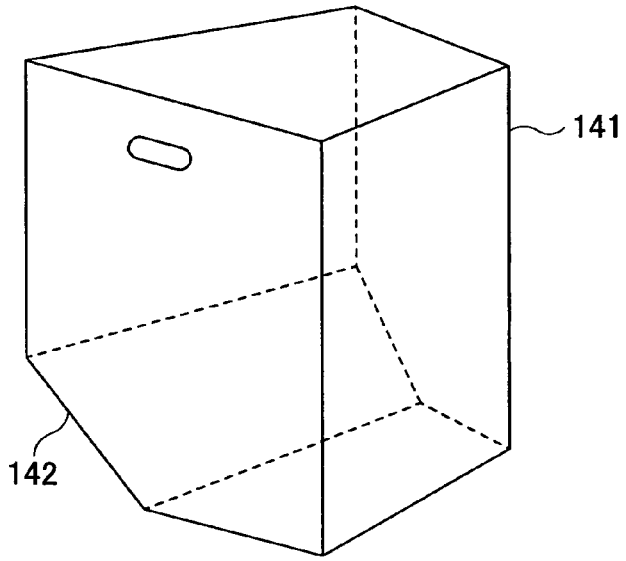
FIG. 3 is a schematic diagram illustrating the configuration of another container unit.

FIG. 3 shows a discharge tray 141, which is an example of a discharge tray in the form of a tray. If the discharge tray 141 in the form of a tray is provided as in this case, the discharge tray 141 is disposed in the position of the above-described discharge port 131 when in use. With this configuration, a user can easily remove the discharged recording sheet. Similar to the discharge port 131, the tray 141 includes a beveled surface 142. The recording sheet detection sensor 125 may be disposed on the beveled surface 142 or may be disposed in the casing by, for example, cutting out a part of the beveled surface 142.

Figure 4:
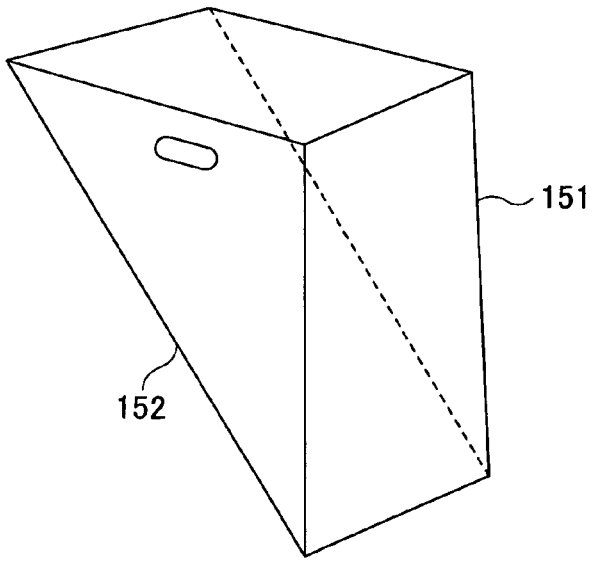
FIG. 4 is a schematic diagram illustrating the configuration of still another container unit.

The discharge tray may have a substantially L shape as shown in FIGS. 1-3, or may have a shape as shown in FIG. 4, for example. In the example of FIG. 4, a slope 152 is provided that diagonally extends from the top of a tray 151 to the bottom of the tray 151.

Figure 5:
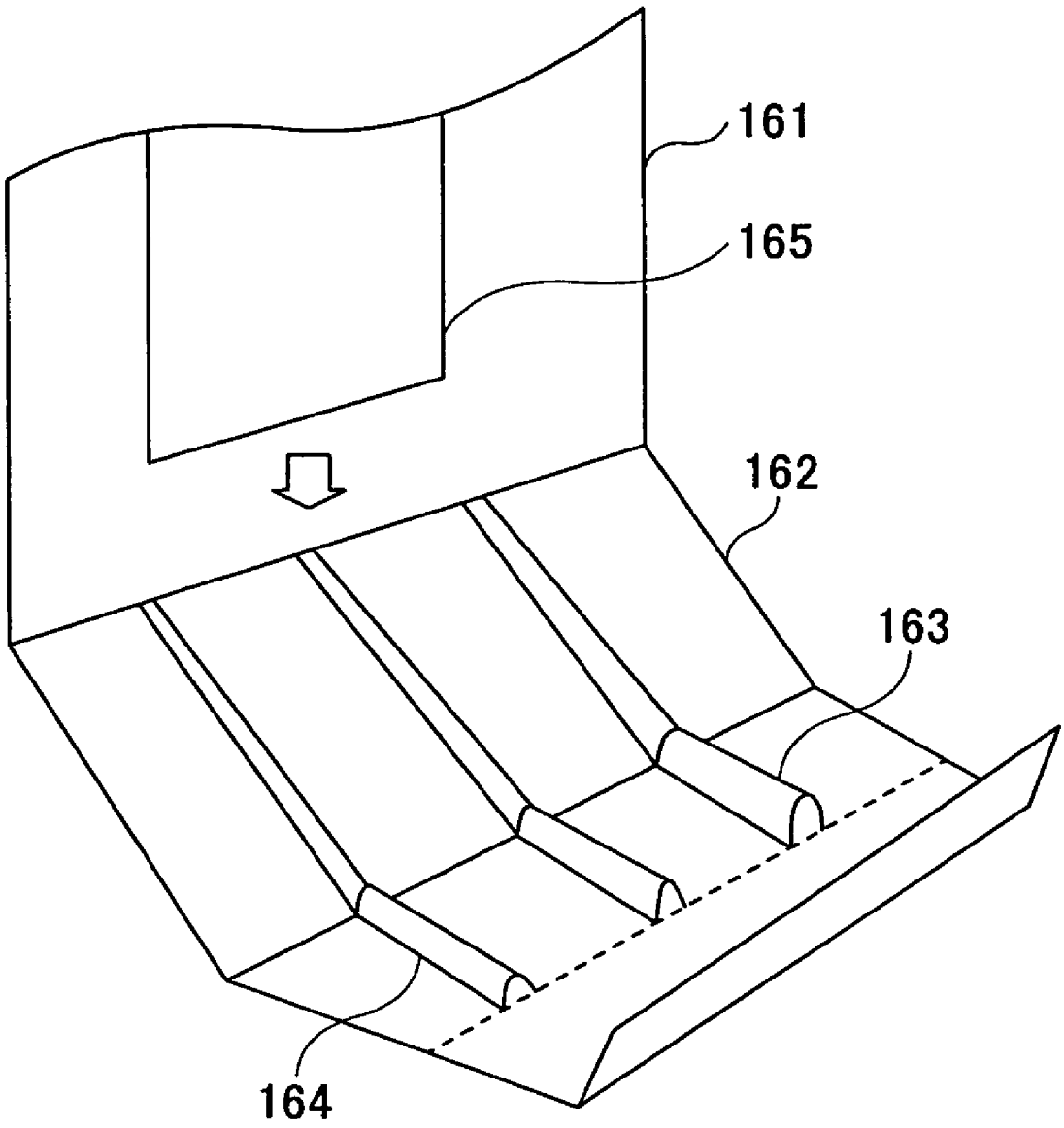
FIG. 5 is a schematic diagram illustrating the configuration of a further container unit.

A slope that extends gradually downward from a far-side direction of the image forming apparatus to the near-side side direction of the image forming apparatus, a rib, or both a slope and a rib may be provided at the bottom of the discharge tray so that a user can more easily remove the discharged recording sheet. For example, in a tray 161 shown in FIG. 5, ribs are formed that extend along a slope 162 and a bottom plate. The rib 163 farthest from the user side has the greatest height. The ribs nearer to the user side have lesser heights. The rib 164 nearest to the user side has the least height. Examples of a material of the ribs may include metal and plastic. In FIG. 5, 165 denotes a discharged recording sheet and an arrow indicates the direction in which the recording sheet is being discharged.

The beveled surface 124 or the like may be curved. If the beveled surface 124 or the like is curved, it is possible to more smoothly stack the recording sheets and to further ensure the detection of the recording sheet by the recording sheet detection sensor 125, etc. An accurate detection can be performed even if, for example, a thick sheet is used as a recording sheet. Therefore, this configuration is preferable. In this case, the leading edge of a recording sheet is smoothly slid into an end of the L-shaped space (the lower right portion of the discharge tray of FIG. 1). Therefore, even if the reverse path D or the discharge path E is relatively long, the discharged recording sheet becomes completely free from the reverse path D or the discharge path E. The tray may not have a slope or a curve. If the tray does not have a slope or a curve, the tray needs to have a sufficient length in the longitudinal direction to allow the trailing edge of a discharged sheet to become free from the reverse path D, etc. If the tray does not have a sufficient length, the discharged recording sheet may become stuck at the end of the paths D or E, so that the discharged recording sheet is hit by the following recording sheet or the sensor 125, etc., fails to detect the recording sheet.

Many recording sheets remaining in the image forming apparatus upon occurrence of a transport error are discharged into the discharge tray 118 or the like. If the number of the recording sheets discharged into the discharge tray 118 or the like exceeds the capacity of the discharge tray 118 or the like, a disadvantageous effect such as paper jam in the image forming apparatus body may be caused. Therefore, it is preferable to maintain the number of recording sheets in the discharge tray 118 or the like less than the capacity of the discharge tray 118 or the like. For this reason as well, it is preferable to detect the presence of a recording sheet using the sensor 125, etc., to report the presence of the recording sheet to a user.

Figure 6:
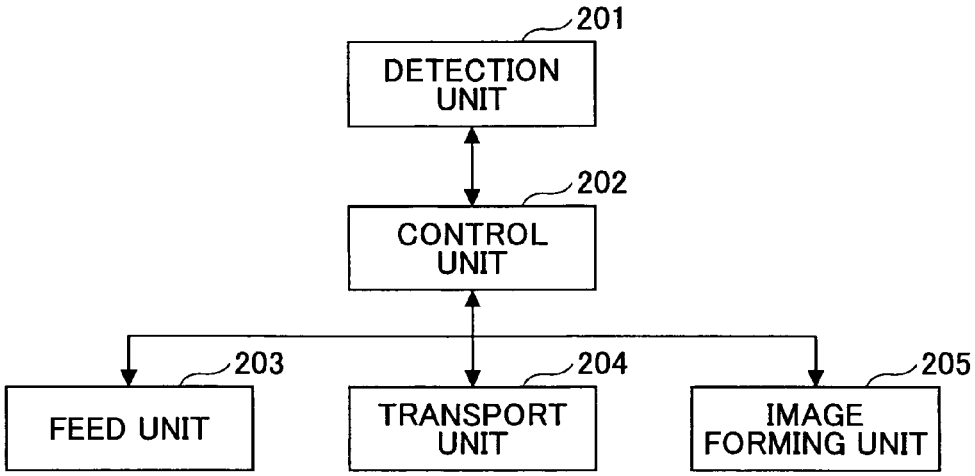
FIG. 6 is a functional block diagram illustrating a relationship between units of the image forming apparatus according to an embodiment.

FIG. 6 is a functional block diagram illustrating a relationship between units of the image forming apparatus according to the present embodiment. A detection unit 201 includes, for example, the sensors 113 through 117 and is configured to detect a transport status of the recording sheet. The control unit 202 includes, for example, a CPU (not shown) and is configured to control operations of the detection unit 201 and operations of a feed unit 203, a transport unit 204, and an image forming unit 205 (described below). The feed unit 203 includes, for example, the feed tray 101 and the feed rollers 103 and is configured to feed a recording sheet for image formation. The transport unit 204 includes, for example, the transport rollers 106 and the transfer rollers 107 and is configured to transport the recording sheet to print the recording sheet by executing an image forming process in the image forming apparatus and to discharge the recording sheet. The image forming unit 205 includes, for example, the transfer belt 112 and the fixing rollers 108 and is configured to execute an image forming process on the recording sheet.

With this configuration, the recording sheet is fed from the feed tray 101 or 102, and undergoes an image forming process while being transported through the transport path A by the transport rollers 106 and the transfer rollers 107. Then the printed recording sheet is discharged into the discharge tray 121. If double-sided printing is selected, the switching claws 119 and 122 are controlled so that the recording sheet passes through the double-sided printing path C and circulates along the transport path A to have the back side of the recording sheet printed. The recording sheet is then discharged.

The non-arrival and operations to be performed upon occurrence of non-arrival are described in greater detail below with reference to FIGS. 7 through 9.

Figure 7:
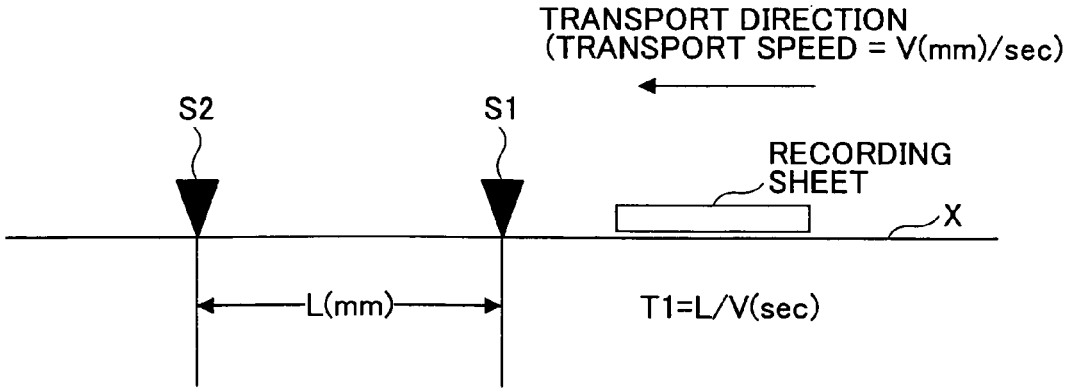
FIG. 7 is a schematic diagram showing a part of a transport path for the purpose of illustrating non-arrival.

FIG. 7 is a schematic diagram illustrating a part of the transport path A. Sensors S and S2 are disposed in a transport path X to sequentially detect a recording sheet being transported in the transport path X. The transport path X corresponds to a part of the transport path A of FIG. 1, and the sensors S1 and S2 correspond to, for example, the sensors 115 and 116 of FIG. 1.

The period of time required for the leading edge of the recording sheet to pass through the sensor S2 after passing through the sensor S1 (the period of time from detection of the leading edge of the recording sheet by the sensor S1 to detection of the leading edge of the recording sheet by the sensor S2, or the period of time from detection of the presence of the recording sheet by the sensor S1 to detection of the presence of the recording sheet by the sensor S2) is L/V (seconds) wherein L (mm) represents the distance between the sensor S1 and the sensor S2 and V (mm/s) represents the transport speed of the recording sheet. Time T1=L/V (seconds) (hereinafter refereed to as a predetermined timing) required for the leading edge of the recording sheet to pass through the sensor S2 after passing through the sensor S1 is previously specified in the apparatus. The time T1 is compared to a timing t1, which is the actual timing of detection of the transported recording sheet by the sensor S2, to classify the status into one of three cases, namely, a case (1) where transport is performed normally, a case (2) where transport is slightly delayed, and a case (3) where transport is greatly delayed.

Figure 8:
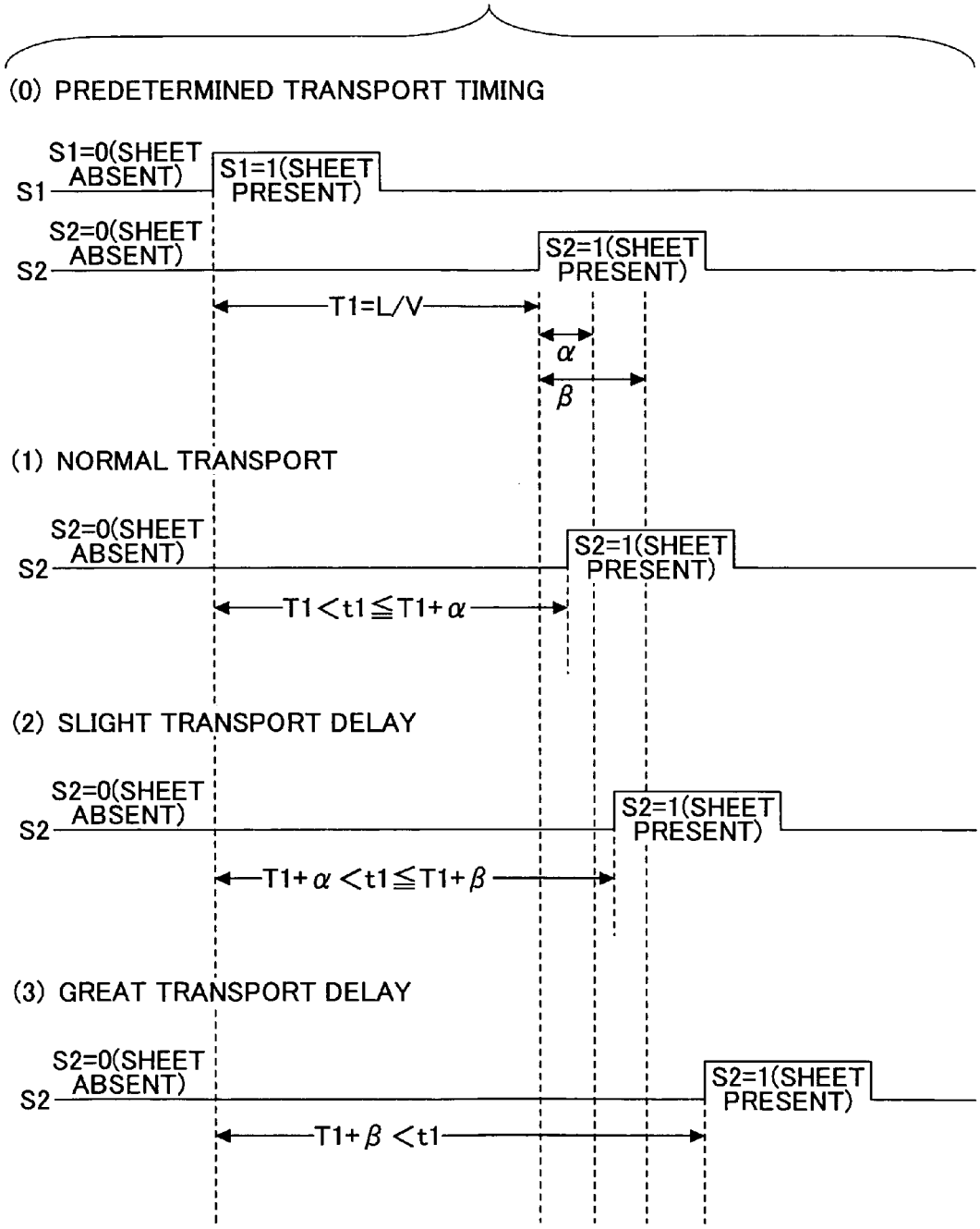
FIG. 8 is a timing chart illustrating detection of the recording sheet by sensors.

FIG. 8 is a timing chart illustrating detection of the recording sheet by the sensors S1 and S2, wherein (0) shows the predetermined transport timing; (1) shows the case where transport is performed normally; (2) shows the case where transport is slightly delayed; and (3) shows the case where transport is greatly delayed. FIG. 9 is a flowchart illustrating operations to be performed in each of the three cases (1) through (3). The following describes how the apparatus is controlled in the case where non-arrival occurs with reference to FIGS. 8 and 9. It is to be noted that detection of the recording sheet and control of the apparatus according to the detection of the recording sheet are realized by the central processing unit (CPU) of the image forming apparatus.

(0) Predetermined timing

As shown in (0) of FIG. 8, when the recording sheet reaches the sensor S1 and the sensor S1 detects the leading edge of the recording sheet, a detection signal S1 is changed from S1=0 (sheet absent) to S1=1 (sheet present). Similarly, when the recording sheet reaches the sensor S2 after passing through the sensor S1, a detection signal S2 is changed from S2=0 (sheet absent) to S2=1 (sheet present). When the trailing edge of the recording sheet passes through the sensors S1 and S2, the detection signal S1 and the detection signal S2 are changed to 0 (sheet absent), respectively. As mentioned above, the period of time from the rise of the signal S1 to the rise of the signal S2 is T1=L/V. In FIG. 8, a delay time $\alpha$ and a delay time $\beta$ are shown for each of the cases.

Case (1) where Transport is Performed Normally

Figure 9:
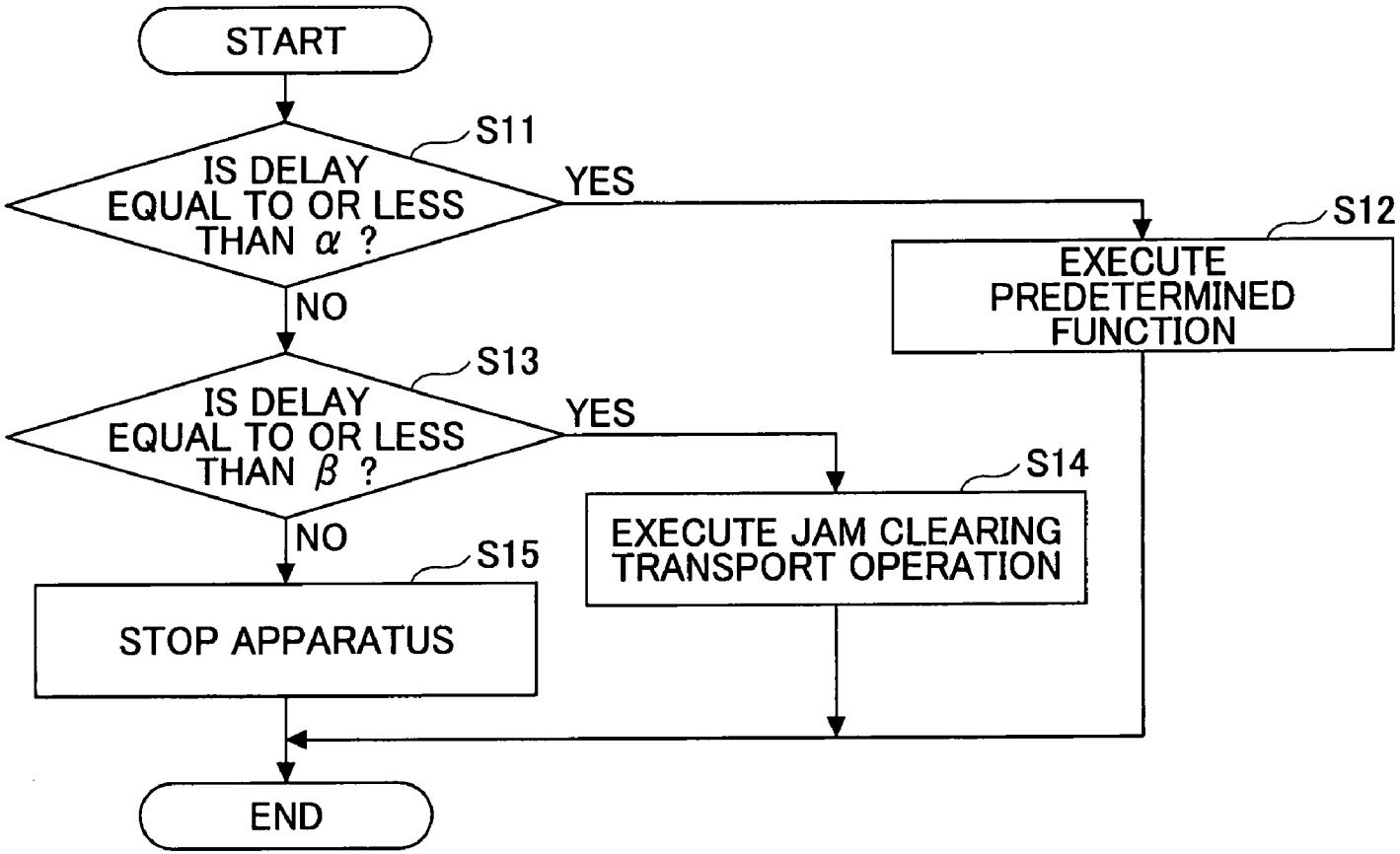
FIG. 9 is a flowchart illustrating operations to be performed according to a transport status of a recording sheet in the case where non-arrival occurs.

As shown in (1) of FIG. 8, if the delay of the detection timing t1 of the leading edge of the recording sheet by the sensor S2 from T1 is equal to or less than the time a (i.e., if $T1<t1\leqq T1+\alpha$ is satisfied), the CPU determines that the recording sheet is transported normally and controls the apparatus to execute a predetermined function (i.e., determines Yes in Step S11 of FIG. 9 and proceeds to Step S12). More specifically, if $\alpha$ is, for example, 60 ms and $T1<t1\leqq T1+60$ ms is satisfied, the CPU determines that the recording sheet is transported normally and causes the apparatus to execute, for example, a transfer function. In the case where t1 is not equal to T1, t1 is normally greater than T1 because of friction of the recording sheet. However, to be on the safe side, it is preferable that the recording sheet is determined to be transported normally if $T1-\alpha<t1\leqq T1+\alpha$ is satisfied.

Case (2) where Transport is Slightly Delayed

As shown in (2) of FIG. 8, if the delay of the detection timing t1 of the leading edge of the recording sheet by the sensor S2 from T1 is greater than the time $\alpha$ but is equal to or less than the time $\beta$ (i.e., if $t1+\alpha<t1\leqq T1+\beta$), the CPU determines that transport of the recording sheet is slightly delayed. Then the CPU causes the apparatus to stop feeding recording sheets from the feed trays 101 and 102 and to execute a transport operation for discharging recording sheets remaining in the apparatus instead of executing the predetermined function (i.e., determines Yes in Step S13 of FIG. 9 and proceeds to Step S14). This transport operation for discharging the recording sheets from the apparatus is called jam clearing transport. More specifically, if $\beta$ is, for example, 120 ms and $t1+60$ ms$<t1\leqq t1+120$ ms is satisfied, the CPU determines that a transport error of the recording sheet has occurred (transport is slightly delayed) and causes the apparatus to continue the transport operation in order to discharge all the recording sheets remaining in the apparatus instead of executing the subsequent transfer function. The reason why this action is taken is that, if a transport error that has occurred in the apparatus is a minor transport error, because the risk of jamming is low, the recording sheets are discharged without stopping the apparatus, thereby reducing the time required to restore operations of the apparatus.

Case (3) where Transport is Greatly Delayed

As shown in (3) of FIG. 8, if the delay of the detection timing t1 of the leading edge of the recording sheet by the sensor S2 from T1 is greater than time $\beta$ (i.e., if $t1+\beta<t1$ is satisfied), the CPU determines that transport of the recording sheet is greatly delayed and immediately stops the apparatus (i.e., determines No in Step S13 of FIG. 9 and proceeds to Step S15). More specifically, if $\beta$ is, for example, 120 ms and $T1+120$ ms$<t1$ is satisfied, the CPU determines that a transport error of the recording sheet has occurred (transport is greatly delayed) and stops the transport system without executing the subsequent transfer function. The reason why this action is taken is that, if a major transport error has occurred in the apparatus, a recording sheet is hit by the following recording sheet, so that the recording sheets cannot be transported (in this case, if transport is continued, the risk of jamming becomes very high). Although β is 120 ms in the above example, the time β is appropriately determined such that the recording sheet causing a transport error is prevented from being hit by the following recording sheet. It is to be noted that the case (3) includes a case where β is infinite, i.e., a case where the sensor S2 could not detect the leading edge of the recording sheet.

Whether recording sheets that are sequentially transported hit each other is dependent on the relative positional relationship between a recording sheet and the following recording sheet. For example, even if a first recording sheet is transported with a delay of 130 ms from a previously specified detection timing, if a second sheet following the first sheet is transported with a delay of 100 ms, the first recording sheet is delayed by only 30 ms relative to the second recording sheet. In this case, the first and second recording sheets do not hit each other. Taking such a case into consideration, correction of the detection timing or transport control may be performed according to detected statuses of recording sheets by the sensors, and if a recording sheet and the following recording sheet are determined not to hit each other, the operations described in the section "Case (2) where transport is slightly delayed" may preferably be performed.

Stay can be understood in the same manner as the above-described non-arrival. While non-arrival is determined based on the detection timing of the leading edge of the recording sheet, stay is determined based on the detection timing of the leading edge and the trailing edge of the recording sheet. Stay and operations to be performed upon occurrence of stay are described below.

Figure 10:
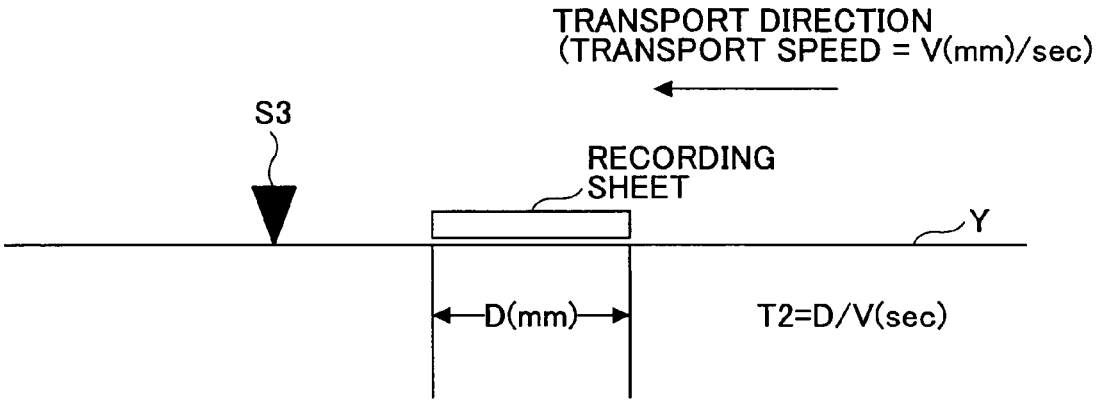
FIG. 10 is a schematic diagram showing a part of a transport path for the purpose of illustrating stay.

FIG. 10 is a schematic diagram illustrating a part of the transport path A. A sensor S3 is disposed in a transport path Y to detect a recording sheet being transported in the transport path Y. The transport path Y corresponds to a part of the transport path A of FIG. 1, and the sensor S3 corresponds to, for example, the sensor 116 of FIG. 1. The period of time required for the trailing edge of the recording sheet to pass through the sensor S3 after the leading edge of the recording sheet passes through the sensor S3 (the period of time from detection of the leading edge of the recording sheet by the sensor S3 to detection of the trailing edge of the recording sheet by the sensor S3, or the period of time from detection of the presence of the recording sheet by the sensor S3 to detection of the absence of the recording sheet by the sensor S3) is D/V (seconds) wherein D (mm) represents the size of the recording sheet in the transport direction and V (mm/s) represents the transport speed of the recording sheet. Time T2=D/V (seconds) required for the trailing edge of the recording sheet to pass through the sensor S3 after the leading edge of the recording sheet passes through the sensor S3 is previously specified in the apparatus. Similar to the case of non-arrival, the time T2 is compared to a timing t2, which is the actual timing of detection of the trailing edge of the transported recording sheet by the sensor S3, to classify the status into one of three cases, namely, the case (1) where transported is performed normally, the case (2) where transport is slightly delayed, and the case (3) where transport is greatly delayed.

Figure 11:
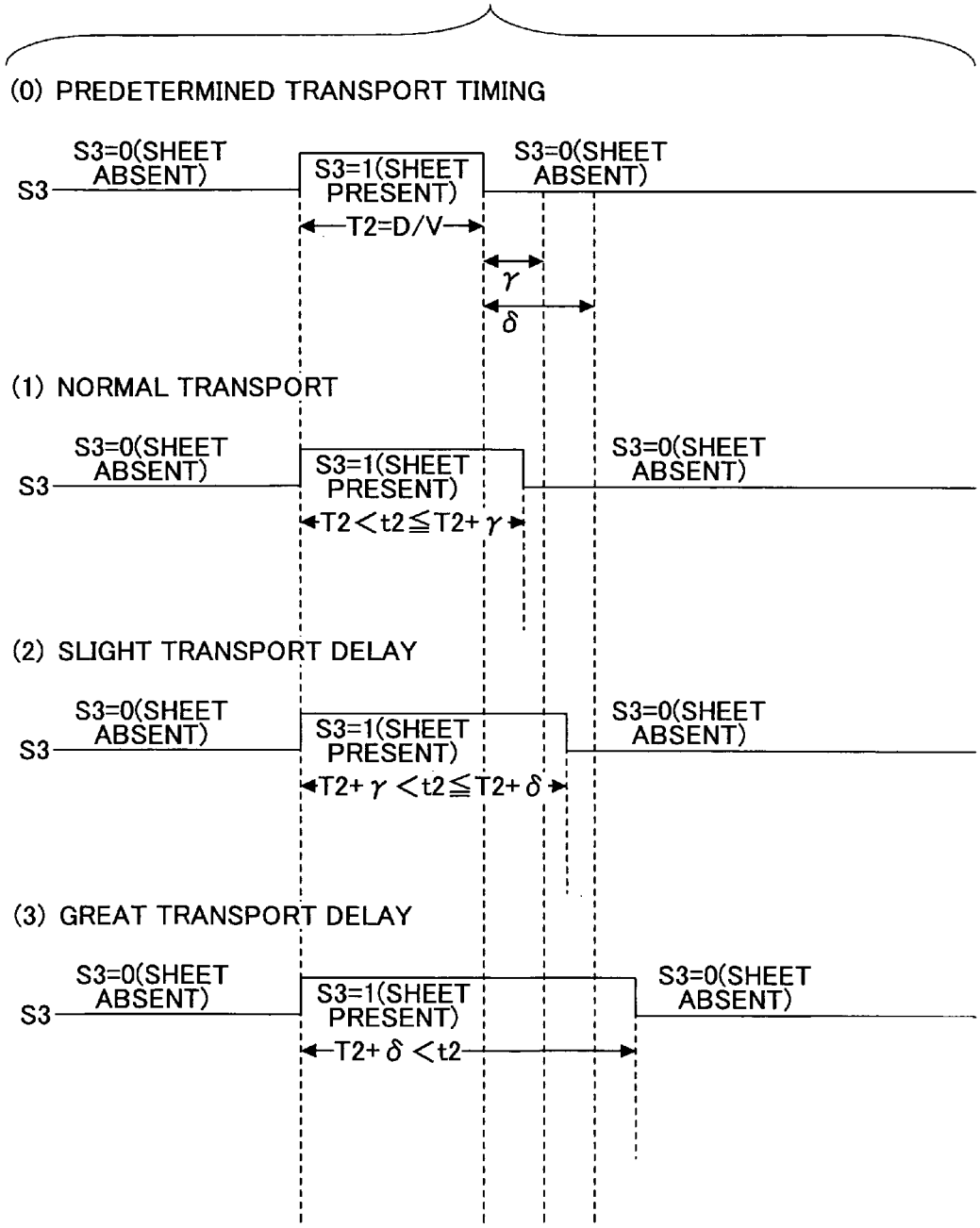
FIG. 11 is a timing chart illustrating detection of the recording sheet by a sensor.
Figure 12:
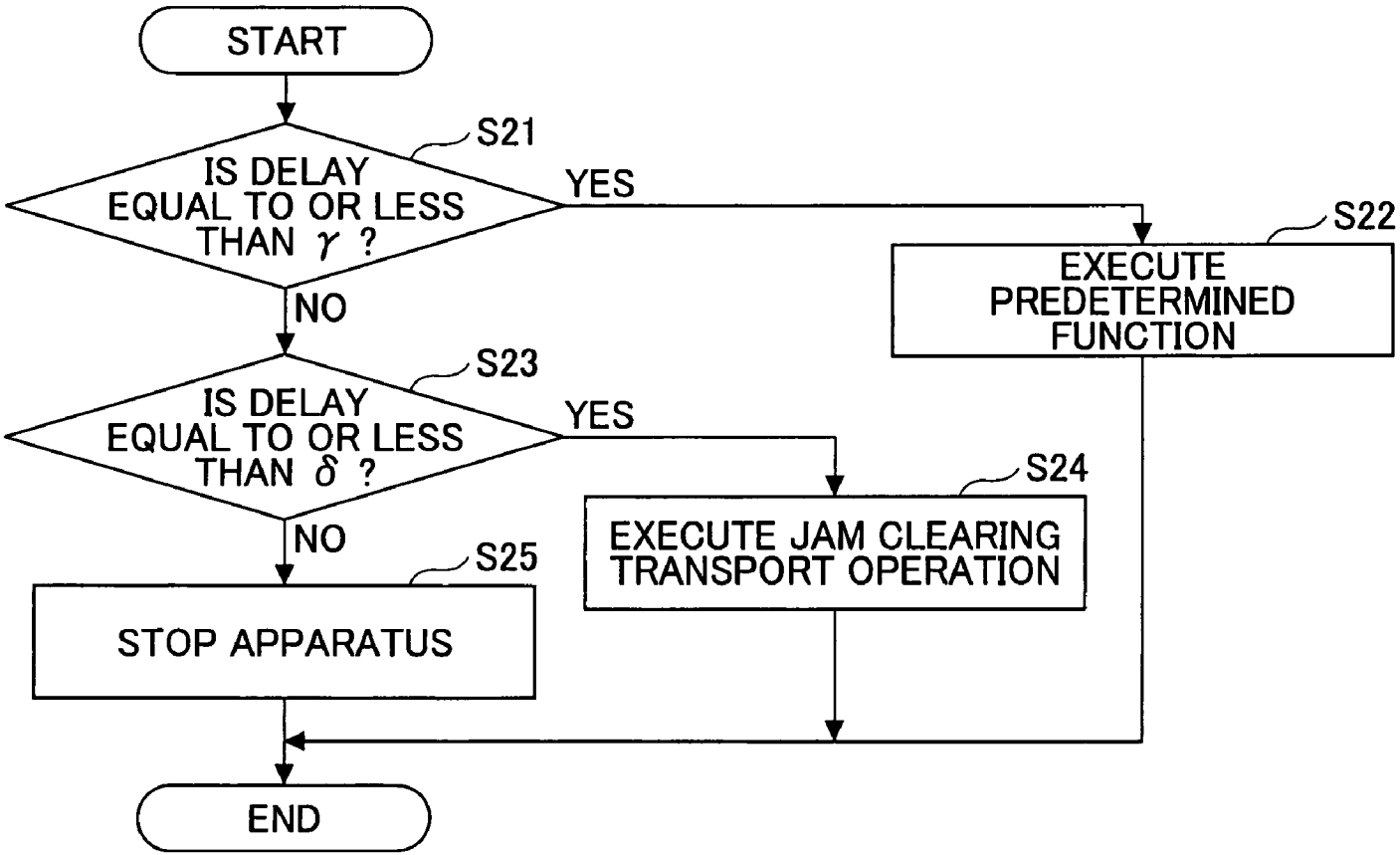
FIG. 12 is a flowchart illustrating operations to be performed according to a transport status of a recording sheet in the case where stay occurs.

FIG. 11 is a timing chart illustrating detection of the recording sheet by the sensor S3, wherein (0) shows the predetermined transport timing; (1) shows the case where transported is performed normally; (2) shows the case where transport is slightly delayed; and (3) shows the case where transport is greatly delayed. FIG. 12 is a flowchart illustrating operations to be performed in each of the three cases (1) through (3). The following describes how the apparatus is controlled in the case where stay occurs with reference to FIGS. 11 and 12.

(0) Predetermined Timing

As shown in (0) of FIG. 11, when the recording sheet reaches the sensor S3 and the sensor S3 detects the leading edge of the recording sheet, a detection signal S3 is changed from S3=0 (sheet absent) to S3=1 (sheet present). When the trailing edge of the recording sheet passes through the sensor S3, the detection signal S3 is changed to S3=0 (sheet absent). As mentioned above, the period of time from the rise to the fall of the signal S3 is T2=D/V. In FIG. 11, a delay time γ and a delay time δ are shown for each of the cases.

Case (1) where Transport is Performed Normally

As shown in (1) of FIG. 11, if the delay of the detection timing t2 of the trailing edge of the recording sheet by the sensor S3 from T2 is equal to or less than the time γ (i.e., if $T2<t2\leqq T2+\gamma$ is satisfied), the CPU determines that the recording sheet is transported normally and controls the apparatus to execute a predetermined function (i.e., determines Yes in Step S21 of FIG. 12 and proceeds to Step S22). More specifically, if γ is, for example, 60 ms and $T2<t2\leqq T2+60$ ms is satisfied, the CPU determines that the recording sheet is transported normally and causes the apparatus to execute, for example, a transfer function. In the example shown in (1) of FIG. 11, the trailing edge of the recording sheet is detected by the sensor S3 with a delay less than γ from T2.

Case (2) where Transport is Slightly Delayed

As shown in (2) of FIG. 11, if the delay of the detection timing t2 of the trailing edge of the recording sheet by the sensor S3 from T2 is greater than the time γ but is equal to or less than the time δ (i.e., if $T2+\gamma<t2\leqq T2+\delta$), the CPU determines that transport of the recording sheet is slightly delayed. Then the CPU causes the apparatus to stop feeding recording sheets from the feed trays 101 and 102 and to execute a jam clearing transport operation for discharging recording sheets remaining in the apparatus instead of executing the predetermined function (i.e., determines Yes in Step S23 of FIG. 12 and proceeds to Step S24).

More specifically, if δ is, for example, 120 ms and $T2+60$ ms$<t2\leqq T2+120$ ms is satisfied, the CPU determines that a transport error of the recording sheet has occurred (transport is slightly delayed) and causes the apparatus to continue the transport operation in order to discharge all the recording sheets remaining in the apparatus instead of executing a transfer function. This action is taken for the same reason as in the case of non-arrival. In the example shown in (2) of FIG. 11, the trailing edge of the recording sheet is detected by the sensor S3 with a delay greater than γ but less than δ from T2.

Case (3) where Transport is Greatly Delayed

As shown in (3) of FIG. 11, if the delay of the detection timing t2 of the trailing edge of the recording sheet by the sensor S3 from T2 is greater than the time δ (i.e., if $T2+\delta<t2$ is satisfied), the CPU determines that transport of the recording sheet is greatly delayed and immediately stops the apparatus (i.e., determines No in Step S23 of FIG. 12 and proceeds to Step S25). More specifically, if δ is, for example, 120 ms and $T2+120$ ms$<t2$ is satisfied, the CPU determines that a transport error of the recording sheet has occurred (transport is greatly delayed) and stops the transport system without executing the subsequent transfer function. This action is taken for the same reason as in the case of non-arrival. The time δ is appropriately determined such that the recording sheet causing a transport error is prevented from being hit by the following recording sheet. In the example shown in (3) of FIG. 11, the trailing edge of the recording sheet is detected by the sensor S3 with a delay greater than δ from T2. It is to be noted that, the case (3) includes a case where δ is infinite, i.e., a case where the sensor S3 could not detect the trailing edge of the recording sheet. As in the case of non-arrival, it is preferable to perform correction of the detection timing or transport control based on whether a recording sheet is hit by the following recording sheet, i.e., based on the relative positional relationship between a recording sheet and the following recording sheet.

Detection of non-arrival and stay and corresponding operations are performed as described above. The subject matter of the present invention particularly relates to the case (2) where transport is slightly delayed. As mentioned above, if transport is determined to be slightly delayed, a jam clearing transport operation is performed. In order to discharge all the recording sheets remaining in the image forming apparatus into a discharge tray by performing a jam clearing transport operation, the rollers of the transport system are driven for a period of time required to discharge all the recording sheets. For example, in the case where an external large capacity tray (LCT) is attached as an option to the image forming apparatus, assuming that a slight transport delay has occurred immediately after feeding a recording sheet from the LCT, the rollers of the transport system may be driven for up to the period of time required to discharge the recording sheet fed from the LCT into the discharge tray (i.e., the period of time required for the recording sheet fed from the LCT to reach the discharge tray. In this case, the rollers of the transport system may be driven, for example, for 4-5 seconds under the present technical level.

Operations of an image forming apparatus capable of performing a jam clearing transport operation are described with reference to FIGS. 13 and 14.

Figure 13:
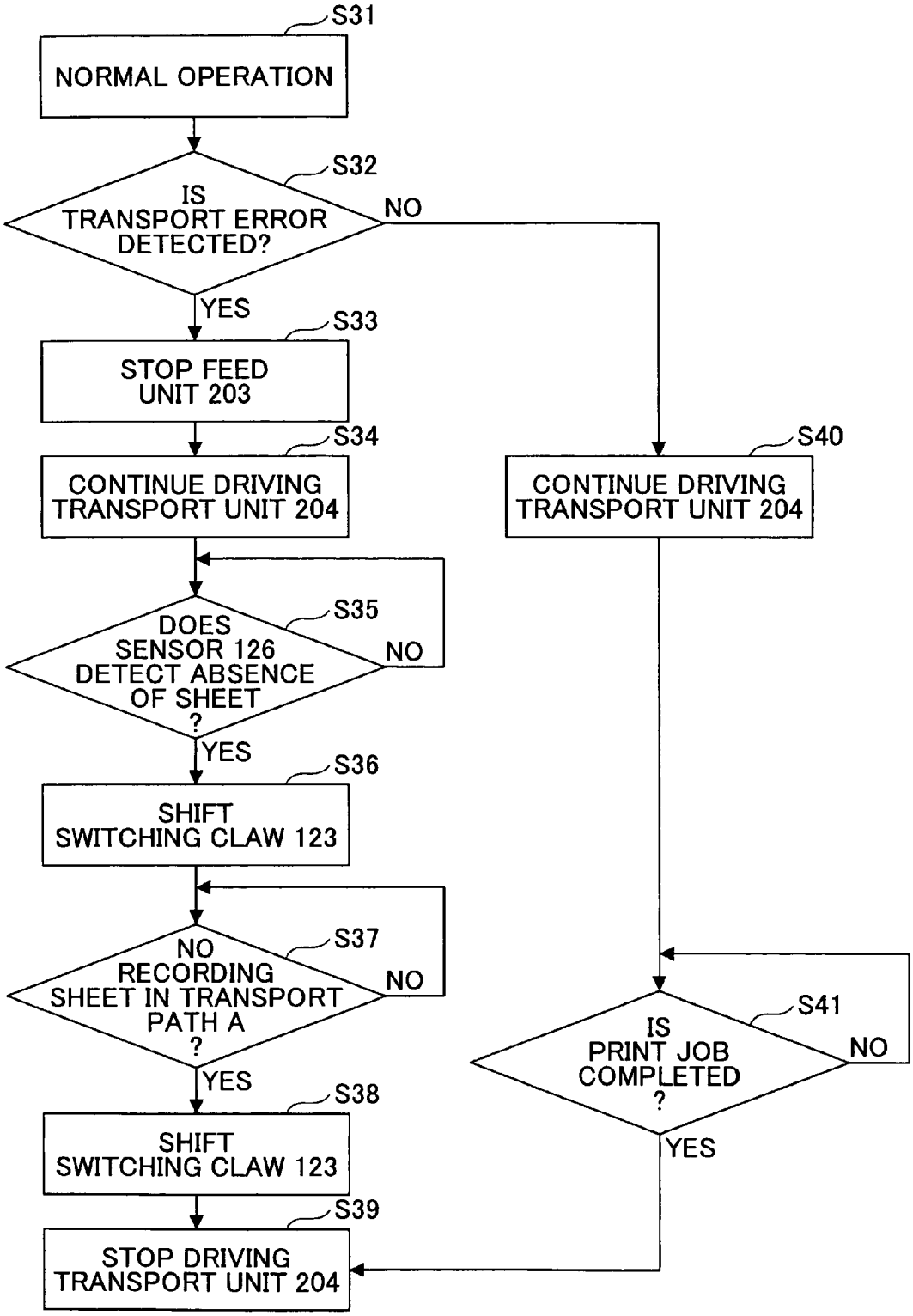
FIG. 13 is a flowchart illustrating operations to be performed after a detection of a transport error.
Figure 14:
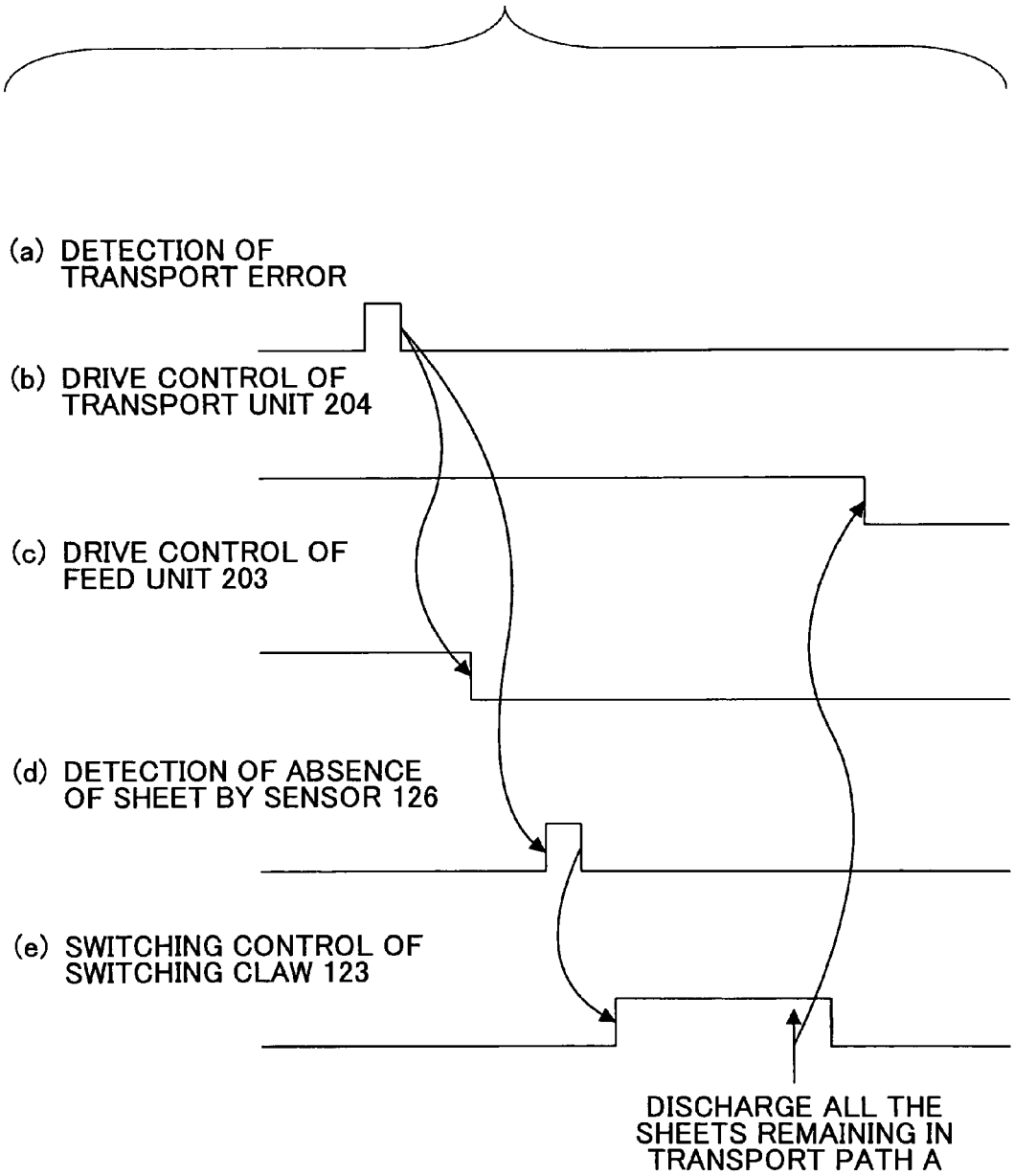
FIG. 14 is a timing chart illustrating operations to be performed after a detection of a transport error.

FIG. 13 and FIG. 14 are a flowchart and a timing chart, respectively, illustrating operations from detection of a transport error, such as non-arrival or stay of a recording sheet, by the transfer timing sensor 116 to discharge of recording sheets remaining in the image forming apparatus into the discharge tray 118. Although the transfer timing sensor 116 detects non-arrival or stay in this example, the other sensors 113-115 and 117 have a function of detecting non-arrival and stay of a recording sheet. The installation positions and the number of the sensors are appropriately determined and do not limit the scope of the present invention.

Referring to FIG. 13, operations are performed normally in Step S31. Then, for example, the transfer timing sensor detects a minor transport error (non arrival) (Yes in Step S32, (a) of FIG. 14). More specifically, transport of a recording sheet is delayed for some reason, so that the leading edge of the recording sheet does not reach the transfer timing sensor 116 when the leading edge of the recording sheet is supposed to reach the transfer timing sensor 116, resulting in non-arrival. Then, in the case of a related-art apparatus, a transport error is determined to have occurred according to a signal from the transfer timing sensor 116 of the detection unit 201, and the apparatus is immediately stopped. On the other hand, the image forming apparatus of this embodiment of the present invention causes the control unit 202 to stop the feed unit 203 to prevent a new recording sheet from being fed to the transport path A (Step S33, (c) of FIG. 14) while continuing driving the transport unit 204 (Step S34, (b) of FIG. 14).

Upon detection of non-arrival by the transfer timing sensor 116, one of the recording sheets remaining in the apparatus may be passing through near the switching claw 123. In this case, after determination using the sensor 126 that the recording sheet has passed through the switching claw 123, the switching claw 123 is controlled to switch the transport direction of the recording sheet to the transport path E. More specifically, in response to a signal from the transfer timing sensor 116 indicating a transport error, the control unit 202 monitors a signal from the sensor 126. When the sensor 126 detects absence of the recording sheet (Yes in Step S35, (d) of FIG. 14), the control unit 202 controls the switching claw 123 (Step S36) to switch the transport direction of the recording sheet from the reverse path D, which is used when the image forming apparatus operates normally, to the discharge path E. Thus the recording sheets that have passed through the flip rollers 110 are sequentially transported to the discharge path E to free-fall into and be held in the discharge tray 118. When the control unit 202 determines that that there is no recording sheet on the transport path A by monitoring the sensors 113-117 and 126 disposed on the transport path A (Yes in Step S37, (e) of FIG. 14), the control unit 202 again controls the switching claw 123 to switch the transport direction to the reverse path D (Step S38, (e) of FIG. 14) and stops driving the transport unit 204 (Step S39, (b) of FIG. 14). In this embodiment, the control unit 202 stops driving the transport unit 204 based on determination using the sensors that there is no recording sheet on the transport path A. In an alternative embodiment, the control unit 202 may stop driving the transport unit 204 after a predetermined time following initiation of the jam clearing transport operation.

Then, a lamp (not shown) or the like provides a user an indication that the recording sheets are held in the discharge tray 118. This indication may be provided visually using a warning lamp or an operations display panel of the image forming apparatus (both not shown) or may be provided audibly using warning sounds according to a detection signal from the recording sheet detection sensor 125 disposed in the discharge tray 118.

If there is no transport error (No in Step S32), the transport unit 204 continues to be driven (Step S40). When a print job is completed (Step S41), the control unit 202 stops driving the transport unit 204 (Step S39).

According to the above control operations, if transport is slightly delayed, in other words, even if there is a risk of causing a jam later on, the recording sheets are discharged without immediately stopping the apparatus. The transport system continues to be driven, and whether an accordion-like jam is actually caused after the slight transport delay is not determined. Accordingly, in the example in which the LCT is attached, continuing driving the rollers of the transport system for 4-5 seconds after detection of non-arrival may cause further damage (i.e., because the transport system is driven for 4-5 seconds after detection of non-arrival, an accordion-like jam may be caused).

To avoid such a problem, as described below, the sensors continue detecting the transport status of the recording sheet during a jam clearing transport operation as well.

Detection of a slight transport delay which may cause a jam is referred to as a first transport error detection for explanation purposes. If a first transport error is detected, a jam clearing transport operation is performed. The sensors continue detecting the transport status of a recording sheet during the jam clearing transport operation as well to monitor whether another transport error such as non-arrival and stay is caused. Detection of another transport error is referred to as a second transport error detection. The second transport error detection is performed in the same manner as detection of non-arrival and stay described above. If a second transport error is detected, because it is assumed that an accordion-like jam which causes great damage is highly likely to be caused (or is actually caused), the apparatus is immediately stopped to prevent further damage.

According to the above control operations, an error code (a code representing the type of a transport error) related to the first transport error detection is displayed on the display panel of the image forming apparatus, although an error code related to the second transport error detection is not displayed. This is because the recording sheets subjected to the second transport error detection are not transported under a normal operation and therefore the information indicating occurrence of the second transport error is not important for a user but the information indicating occurrence of the first transport error is important for the user. Although an error code related to the second transport error detection is not displayed, the warning lamp may indicate the place in the apparatus where the recording sheet remains so as not to cause any trouble for a user. The type of the first transport error may be used as reference information upon repairing the apparatus, for example.

In this way, if a transport error occurs, all the recording sheets in the transport path A are discharged into the discharge tray 118. Therefore, a user can restore the image forming apparatus to operate normally as soon as the user removes the recording sheets held in the discharge tray 118.

In this embodiment, all the recording sheets in the transport path A are discharged into the discharge tray 118. In an alternative embodiment, a discharge path that provides a similar function as the function of the discharge path E is provided in the transport path A and the recording sheets are discharged into plural container units in addition to the discharge tray 118. In another alternative embodiment, evacuation sections for recording sheets are provided on the transport path A in place of the container unit so that the recording sheets are evacuated into plural positions in addition to the discharge tray 118.

In these alternative embodiments, the arrangement is preferably determined taking a user convenience into consideration such that a user can easily restore operations of the apparatus.

In the case of stay, the recording sheets remaining in the image forming apparatus can be discharged into the discharge tray 118 in the same manner as in the case of non-arrival described above.

As described above, according to this embodiment of the present invention, even if a transport error such as non-arrival and stay occurs, if a recording sheet is transported within a predetermined period of time, the transport unit continues to be driven to remove the recording sheets remaining in the transport path A. Therefore, even if non-arrival or stay occurs, a user can easily and quickly restore operations of the image forming apparatus by only removing the recording sheets from the discharge tray after the apparatus stops. Accordingly, it is possible to reduce the total time to perform a series of printing operations.

The present invention also relates to a high-speed image forming apparatus capable of reducing downtime.

Image forming apparatuses, such as a copying machine and a printer, transport a sheet as a recording medium inside the apparatus and transfer a toner image or an ink image onto the sheet. Therefore, jamming due to transport of the sheet is inevitable. A related-art image forming apparatus stops a transport operation in response to detection of a jam, and issues an alarm to a user such that the user removes the jammed sheet.

The image forming apparatus often includes function-based units. In other words, plural units are present in the image forming apparatus. The user removes these units in order to remove the jammed sheet. In the case where the jammed sheet is stopped across plural units, when one of the units is removed by the user, the sheet is damaged and torn, making removal of the jammed sheet troublesome.

An image forming apparatus is disclosed that solves such a problem. If a jam occurs, the image forming apparatus causes a sheet being transported in the apparatus to stop in an appropriate position where the sheet does not extend across plural units, thereby preventing the sheet from being torn. This can reduce the time required for a user to clear the jam.

However, even if transport is controlled to prevent a sheet from extending across plural units upon occurrence of a jam, the user still needs to clear the jam.

In the case of high-speed image forming apparatuses, in order to perform image forming operations at high speed, it is necessary to reduce the distance between the sheets circulating in the apparatus and thus increase the number of sheets circulating in the apparatus. That is, if a jam occurs in the high-speed image forming apparatuses, sheets tend to remain in many places.

In the case where the sheets remain in many places upon occurrence of a jam, it is necessary to remove the sheets from many places.

Therefore, even if the time required to remove the sheet from each place is reduced by preventing the sheet being torn, the total time required to clear the jam is not reduced.

In view of the foregoing, the present invention is directed toward providing an image forming apparatus capable of reducing downtime due to a transport failure (transport error) such as a jam to improve the productivity of the apparatus.

In an embodiment of the present invention, there is provided an image forming apparatus that, if a transport failure is detected, switches to an operation of discharging media without stopping transporting the media. This discharge operation causes the media to be collected into a predetermined place in the transport path.

According to the above-described embodiment of the present invention, if a transport failure occurs, the media are collected into a predetermined place in the transport path. Therefore, a user only needs to remove the media from the limited place instead of removing the media from many places. In one aspect of the present invention, it is possible to provide an image forming apparatus that performs a medium transporting method that can reduce downtime due to a transport failure and improve the productivity.

First, the basic idea of an embodiment of the present invention is described below. The possible cause of jamming includes, first, a situation in which a sheet is folded like an accordion and stuck in a transport path. The possible cause of jamming includes, second, a situation in which transport of a sheet is simply delayed from a regular timing due to slippage of a roller or the like.

The situation in which a sheet is folded like an accordion and stuck is discussed in terms of a relationship with a given place of a sheet transport path. If a sheet is folded like an accordion and stuck in a place upstream a given place in a transport path, a non-arrival jam indicating a non-arrival of a sheet is detected in the given place. On the other hand, if a sheet is folded like an accordion and stuck in the given place in the transport path, a stay jam indicating a presence of a sheet not moving from the given place to the downstream is detected in the given place.

If a sheet is folded like an accordion and stuck and these jams are detected, it is necessary to stop the operation of the apparatus so that a user removes the sheet folded like an accordion. It is to be noted that the upstream indicates the direction in which a sheet is transported toward a given place as a reference point, i.e., the direction close to a feed tray. The downstream indicates the direction in which a sheet is transported away from the given place as a reference point, i.e., the direction close to a discharge tray.

As mentioned above, the cause of a non-arrival jam may be a situation in which a sheet does not arrive at an appropriate timing and is simply delayed due to slippage of a roller or the like. In this case, if this situation is recognized as a jam and therefore the transport operation is stopped although the transport operation of the sheet is being performed, the productivity of image formation is reduced.

Inventors of the present invention have found that many non-arrival jams result from a sheet that has not reached a predetermined place at an appropriate timing. In order to improve the operating speed and eventually the productivity of the image forming apparatus, the transport operation is not stopped even if a non-arrival jam is detected. That is, if a jam occurs, the image forming apparatus switches to an operation of discharging a sheet and thus transports the sheet to the discharge destination.

If another jam is detected during this discharge transport operation, it is highly likely that a sheet is folded like an accordion and stuck in the transport path. If the sheet discharge transport operation is continued in this case, the subsequent sheet hits the sheet folded like an accordion and may cause a more complex jam. To avoid such a problem, in this case, the sheet transport operation is stopped.

In the image forming apparatuses, other than the above-described non-arrival jam and stay jam, multi-feeding, which is a situation in which plural stacked sheets are transported together, and skewing, which is a situation in which a sheet is transported at an angle relative to the transport direction, may occur. Multi-feeding and skewing are less likely to result in a situation that causes the image forming apparatus to stop. However, these situations are highly likely to result in a paper jam. Even if a paper jam does not occur, multi-feeding and skewing reduce the quality of image formation. Therefore, it is preferable to handle multi-feeding and skewing as a jam.

Therefore, in an embodiment of the present invention, multi-feeding and skewing are handled in the same manner as a non-arrival jam. In the following description, non-arrival due to slippage of a roller or the like, multi-feeding, and skewing are collectively called as a transport failure.

Figure 17:
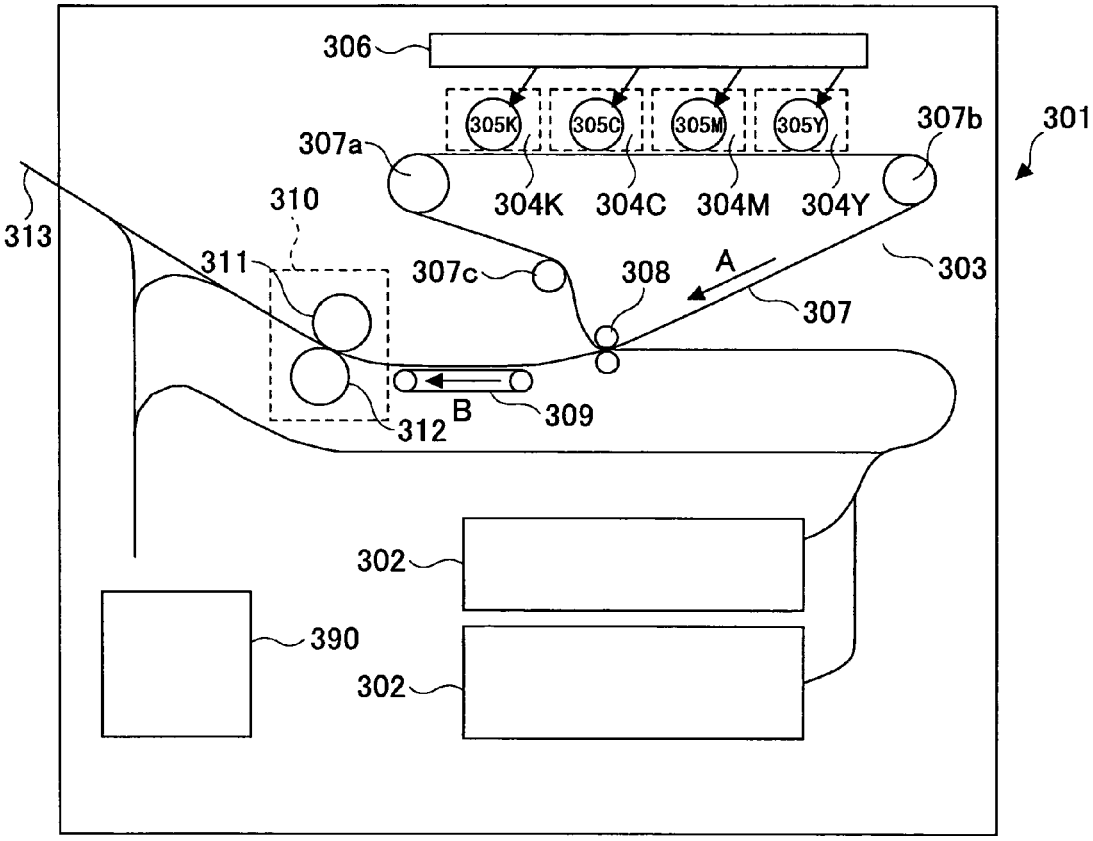
FIG. 17 is a schematic configuration diagram illustrating an image forming apparatus according to an embodiment of the present invention.

An embodiment of the present invention is described below with reference to the accompanying drawings. FIG. 17 is a schematic configuration diagram illustrating an image forming apparatus 301 according to this embodiment of the present invention.

The image forming apparatus 301 includes a feed unit 302. Plural sheets as recording media on which toner images are to be transferred and recorded are held in the feed unit 302. The sheet in the feed unit 302 is transported by a pickup roller, a transport roller, etc., (not shown) and is fed to an image forming unit 303.

The image forming unit 303 includes image forming stations 304Y, 304M, 304C, and 304K. The image forming stations 304Y, 304M, 304C, and 304K include photoreceptor drums 305Y, 305M, 305C, and 305K, respectively, for the basic colors for image formation, namely, yellow (Y), magenta (M), cyan (C), and black (K). A laser unit 306 is provided that emits laser beams with image data superposed thereon to each of the image forming stations. The laser beams emitted from the laser unit 306 scan the surfaces of the corresponding photoreceptor drums 305Y, 305M, 305C, and 305K, so that a latent image is formed on each photoreceptor drum.

The latent image formed on each photoreceptor drum is developed by a well-known development process to become a toner image. Although a charging unit, a developing unit, and a cleaning unit are disposed in the vicinity of each of the photoreceptor drums 305Y, 305M, 305C, and 305K, the illustration and the detailed description of these components are omitted. The toner images of the basic colors that are developed and visualized by the image forming stations are superposed on each other and transferred onto a transfer belt 307. Thus a color image is formed.

The transfer belt 307 extends across a driving roller 307*a*, driven rollers 307*b* and 307*c*, and secondary transfer rollers 308. The transfer belt 307 is driven by the driving roller 307*a* and moves in the direction of arrow A of FIG. 17. The color toner image formed on the transfer belt 307 is transferred by the secondary transfer rollers 308 onto a sheet being transported. The sheet on which the color image is transferred passes through the secondary transfer rollers 308 and is sent onto a transport belt 309. The transport belt 309 transports and feeds the sheet to a fixing unit 310 in the next stage.

The fixing unit 310 includes a fixing roller 311 and a pressure roller 312. The fixing roller 311, which is heated by a heating unit such as a halogen heater and an IH heater, heats and melts the toner image on the sheet. The melted toner is pressed and fixed onto the sheet at a nip portion formed by a contact point between the fixing roller 311 and the pressure roller 312. After passing through the fixing unit 310, the sheet is discharged into a discharge tray 313. Or, in the case of double-sided printing, the sheet is fed to a double-sided transport path.

Figure 18:
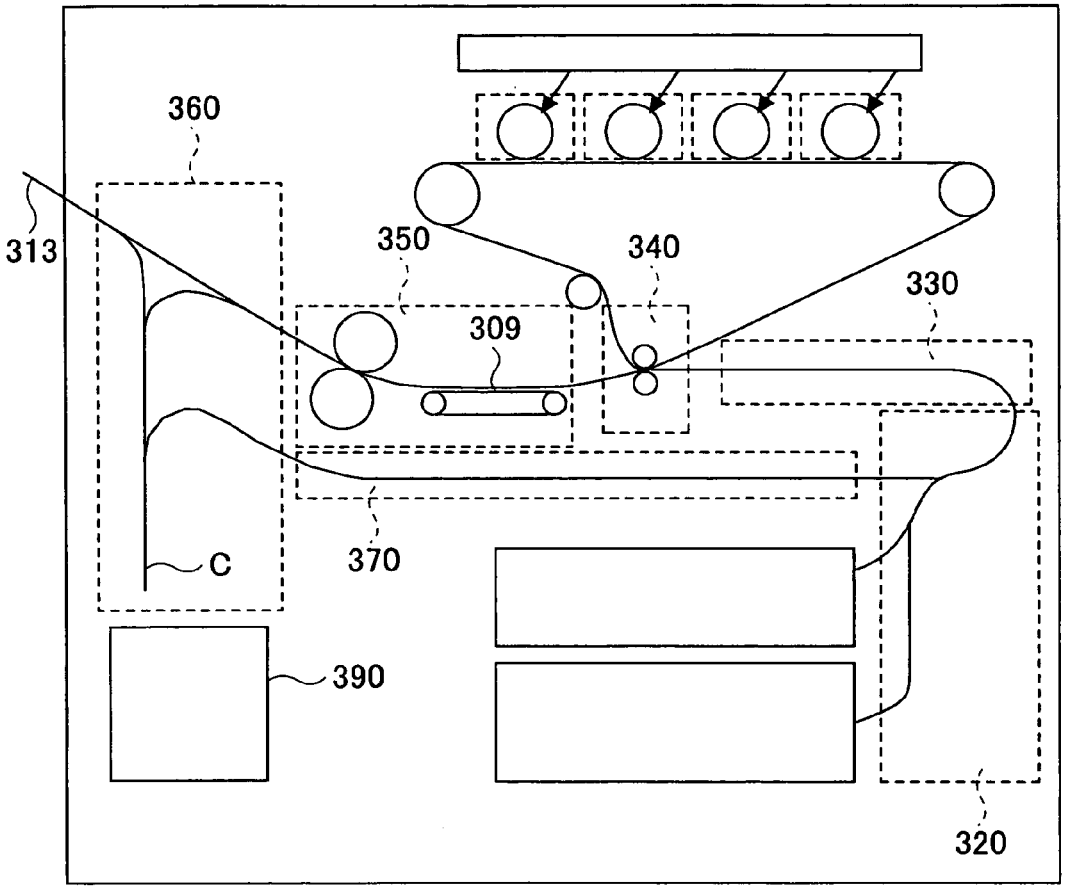
FIG. 18 is a diagram illustrating a sheet transport path.

A detailed description of how to transport a sheet is given below. In the following description (see FIG. 18), a sheet transport path in the image forming apparatus of this embodiment is divided into plural areas.

More specifically, the sheet transport path in the image forming apparatus of this embodiment is divided into a feed area 320, a registration area 330, a secondary transfer area 340, a fixing area 350, and a reverse-discharge area 360 in this order from the upstream to the downstream. The reverse-discharge area 360 discharges the sheet toward the discharge tray 313. The reverse-discharge area 360 is connected to the double-sided transport area 370. The downstream of the double-sided transport area 370 is connected to the feed area 320.

Although many components for transporting the sheet such as rollers and sheet guides are disposed on the sheet transport path, these components are not main components of the present invention. Therefore, the illustration and the detailed description of these components are omitted.

A sheet is picked up from the feed unit 302 and is first guided to the feed area 320. The feed area 320 generally extends between a pick up roller (not shown) of the feed unit 302 from a registration roller (not shown). The registration roller has a function of temporarily stops the sheet in order to adjust the timing of transferring the toner image formed on the transfer belt 307 onto the sheet.

The sheet passes through the feed area 320 and reaches the registration area 330. In the transport path in the registration area 330, multi-feeding and skewing are detected (if any). The registration area 330 extends from a position immediately after the registration roller (not shown) to a position immediately before the secondary transfer roller 308.

The sheet passes through the registration area 330 and reaches the secondary transfer area 340, in which, as mentioned above, the toner image formed on the transfer belt 307 is transferred onto the sheet by the secondary transfer rollers 308. The secondary transfer area 340 extends around the secondary transfer rollers 308.

The sheet passes through the secondary transfer area 340 and reaches the fixing area 350, in which the sheet is transported to the fixing unit 310 by the transport belt 309. Then, as mentioned above, the toner image formed on the sheet is heated and pressed by the fixing roller 311 and the pressure roller 312 so that the toner image is fixed on the sheet. The fixing area 350 covers the transport belt 309 to the fixing unit 310.

The sheet passes through the fixing area 350 and reaches the reverse-discharge area 360. If the sheet that has reached the reverse-discharge area 360 is specified to be printed on one side only, the sheet is guided to a reverse path C in the reverse-discharge area 360. Then, the sheet is reversed by being withdrawn from the reverse path C toward the discharge tray 313. Thus, the sheet is discharged with its face down, i.e., with the side on which the image is formed facing downward.

If the sheet that has reached the reverse-discharge area 360 is specified to be printed on both sides, the sheet is guided to the reverse path C in the reverse-discharge area 360 as in the above case. Then, the sheet is reversed by being withdrawn from the reverse path C toward the double-sided transport area 370. The sheet passes through the double-sided transport area 370 and returns to the feed area 320.

Then the sheet passes through the registration area 330 and reaches the secondary transfer area 340. In the secondary transfer area 340, a toner image is transferred onto the side of the sheet opposite to the side on which the image has been already formed. The sheet passes through the fixing area 350 and reaches the reverse-discharge area 360. The sheet is directly guided and discharged into the discharge tray 313 without being guided to the reverse path C.

Sensors for detecting the sheet are disposed in plural places in these areas. For example, a registration entrance sensor for detecting the arrival of the sheet to the registration area 330 is disposed at the entrance of the registration area 330. A multi-feeding sensor for detecting multi-feeding of the sheets and a skew sensor for detecting a skew of the sheet are also disposed in the registration area 330. A transfer timing sensor for determining the timing of transferring the toner image formed on the transfer belt 307 onto the sheet is disposed in the secondary transfer area 340.

A transport jam sensor for detecting a jam on the transport belt 309 and a fixing jam sensor for detecting a jam in the fixing unit 310 are disposed in the fixing area 350. The transport jam sensor detects a jam on the transport belt 309 by detecting whether the sheet fed from the secondary transfer area 340 is normally transported by the transport belt 309. The jam sensor detects a jam in the fixing unit 310 by detecting whether the sheet is transported from the fixing unit 310 to the downstream.

A switch back sensor for detecting whether the sheet is guided to the reverse path C is disposed in the reverse-discharge area 360.

Although not shown, these sensors are disposed along the transport path. The sensors may be disposed in other suitable places. These sensors include, for example, a light emitting element and a light receiving element. The light emitted from the light emitting element is reflected by the surface of the sheet. The light receiving element is disposed in a position to which the light is reflected by the surface of the sheet. According to this configuration, the reflected light becomes incident on the light receiving element when the sheet passes through the sensor position. As a result, the light receiving element outputs a current. Detection of this output current indicates that the sheet has passed through the sensor.

These sensors are connected to a control unit (not shown) of the image forming apparatus. The control unit detects the output current from the light receiving element of each sensor to recognize that the sheet has passed through the sensor. The control unit calculates the appropriate timing for the sheet to pass through each sensor based on the image conditions such as image forming speed. Alternatively, the appropriate timing may be previously calculated and stored in a memory unit.

The control unit can determine whether the sheet has reached and passed through the sensor at the appropriate timing by comparing the appropriate timing with the timing when the sensor actually detected the sheet. In other words, the control unit can detect a non-arrival jam and the location of the non-arrival jam.

If a first transport failure is detected by any of these sensors, the image forming apparatus of this embodiment switches to an operation of discharging a sheet causing the transport failure and thus transports the sheet to the discharge destination. In this embodiment, a first transport failure refers to a transport failure that is detected while the image forming apparatus operates normally.

In this embodiment, if a second transport failure is detected by any of the sensors, because it is determined that there may be a situation such as an accordion-like jam that causes the sheet to stop, the image forming apparatus stops the operation of transporting the sheet to the discharge destination. In this embodiment, a second transport failure refers to a transport failure that is caused during the transport operation continuing after the detection of the first transport failure and is detected by the sensor that has detected the first transport failure.

If the transport operation is stopped in response to the detection of the second transport failure, the image forming apparatus determines that an accordion-like jam is highly likely to have occurred in the transport path and therefore stops the operation of transporting the sheet to the discharge destination in order to prevent the occurrence of a more complex jam. The image forming apparatus not only stops the transport operation and but also provides an error message to a user. Thus the image forming apparatus prompts the user to remove the sheet causing the transport failure. If the user removes the sheet causing the transport failure in response to the message and the image forming apparatus is brought back to the normal operation, the next transport failure is recognized as a first transport failure.

A detailed description is given below by taking a non-arrival jam as an example. In this embodiment, the image forming apparatus switches to a discharge transport operation of transporting the jammed sheet to a discharge area. The following descries the operations to be performed in each area of the image forming apparatus of this embodiment in response to the detection of a first non-arrival jam, focusing on the relationship with the location where the non-arrival jam is detected.

In the case where a non-arrival jam is detected in the feed area 320, the image forming apparatus stops picking up a new sheet from the feed unit 302. The sheets remaining downstream the jammed sheet are transported to the discharge tray 313, if possible. For example, if sheets specified to be printed on one side only are transported downstream the jammed sheet, theses sheets go through image formation, transfer, and fixing processes as they normally do, are reversed in the reverse-discharge area 360, and are discharged into the discharge tray 313.

If sheets specified to be printed on both sides and having both sides already printed are transported downstream the jammed sheet, these sheets are also discharged into the discharge tray 313. In this case, however, the sheets are not reversed in the reverse-discharge area 360.

On the other hand, if sheets specified to be printed on both sides and having only one side printed are transported downstream the jammed sheet, a different operation is performed. Even if the sheets are guided from the reverse-discharge area 360 to the double-sided transport area 370 and return to the feed area 320, the sheets cannot be transported further. Therefore, the image forming apparatus discharges the sheets into a jam discharge tray 390 disposed under the reverse path C.

In the case where a non-arrival jam is detected in the registration area 330, the image forming apparatus stops picking up a new sheet from the feed unit 302. As in the case described above, the sheets remaining downstream the jammed sheet are transported to the discharge tray 313, if possible. In the case where a non-arrival jam is detected in the secondary transfer area 340 or the fixing area 350, the same operation is performed as described above.

If a non-arrival jam is detected by the fixing jam sensor, there may be a sheet remaining on the transport belt 309 upstream the fixing jam sensor or in the fixing unit 310. Especially, in the case where a sheet remains in the fixing unit 310, because the sheet might be overheated by the heat of the fixing unit 310, it is advantageous to stop supplying power to the fixing unit 310.

In the case where a non-arrival jam is detected in the reverse-discharge area 360, depending on the position of the jammed sheet, the sheets upstream and downstream the jammed sheet may be blocked by the jammed sheet and be prevented from being guided to the discharge tray 313 or the jam discharge tray 390. In such a case, the sheets upstream and downstream the jammed sheet are transported to and stopped at appropriate positions. For example, the sheet may be transported to and stopped at a position in which the sheet is prevented from being torn due to removal of a unit of the apparatus, or may be transported to and stopped on the transport belt 309.

In the case where multi-feeding or skewing is detected, the image forming apparatus of this embodiment performs an operation similar to that in the case of detection of a non-arrival jam. For example, in the case where a transport failure such as multi-feeding and skewing is detected in the registration area 330, the image forming apparatus stops picking up a new sheet from the feed unit 302. The sheets remaining downstream the jammed sheet are transported to the discharge tray 313, if possible.

According to this embodiment, if a second non-arrival jam is detected during a discharge transport operation after detection of a first non-arrival jam, the image forming apparatus determines that an accordion-like jam has occurred upstream of or in the position of a sensor that has detected the non-arrival jam and therefore stops the discharge transport operation.

The above-described operations performed in response to detection of a transport failure are executed by a controller (not shown) inside the image forming apparatus. Although the controller is not described herein, the controller may execute the operations using a common processor.

In this embodiment, the image forming apparatus starts a discharge transport operation in response to detection of a first transport failure without stopping a transport operation. The sheets are collected into predetermined places by the discharge transport operation. Therefore, the downtime of the apparatus can be reduced compared to the image forming apparatus that stops a transport operation each time a transport failure is detected.

Furthermore, in the case where a transport failure occurs, because the sheets are collected into limited places by the discharge transport operation, it is highly likely that a user can clear the jam by removing the sheets from only these places. In other words, the user does not need to remove the sheets from many places each time a transport failure occurs, so that the time required to clear the jam can be reduced.

In the above example, if a first transport failure is detected by any of the sensors, a discharge transport operation is started. Then, if a second transport failure is detected during the discharge transport operation, the transport operation is stopped. A flag may be used to determine whether a detected transport failure is a first transport failure or a second transport failure. For example, a one-bit flag may be provided and be referred to when determining whether the image forming apparatus operates normally. The flag is set to "0" when the image forming apparatus operates normally, while the flag is set to "1" when a discharge transport operation is performed. The default value of the flag may be "0".

The image forming apparatus refers to the value of the flag when a transport failure is detected by any of the sensors. If the value of the flag is "0", the image forming apparatus determines that the transport failure is a first transport failure. Then the image forming apparatus starts a discharge transport operation and sets the value of the flag to "1". When the sheets are collected into the jam discharge tray 390 or the onto the transport belt 309 by the discharge transport operation and the jam is cleared by a user, the value of the flag is reset to "0".

If the value of the flag is "1" at the time of detection of a transport failure by any of the sensors, the image forming apparatus determines that the discharge transport operation is being performed and therefore stops the discharge transport operation. Then, as in the above case, when the jam is cleared by a user, the value of the flag is reset to "0".

The present application is based on Japanese Priority Applications No. 2007-205821, No. 2007-214872, and No. 2008-161190, filed on Aug. 7, 2007, Aug. 21, 2007, and Jun. 20, 2008, respectively, with the Japanese Patent Office, the entire contents of which are hereby incorporated herein by reference.

What is claimed is:

1. Image forming apparatus, comprising:

a recording medium feed unit configured to feed a recording medium into a predetermined transport path;

a transport unit configured to transport said recording medium fed by the recording medium feed unit along the transport path;

a transport status detection unit disposed on the transport path and configured to detect a transport status of said recording medium;

a control unit configured to control operations of the recording medium feed unit, the transport unit, and the transport status detection unit; and a container unit configured to hold said recording medium, wherein the control unit controls, according to a detection result by the transport status detection unit, feeding of another recording medium by the recording medium feed unit and transport of said recording medium by the transport unit to discharge said recording medium and still another recording medium present in the transport path into the container unit, and wherein if the transport status detection unit detects a delay in transporting said recording medium and detects that a distance between said recording medium and a subsequent recording medium is within a predetermined range, the control unit controls the recording medium feed unit to stop feeding said another recording medium and controls the transport unit to continue transporting said recording medium and said still another recording medium for a predetermined period of time.

2. The image forming apparatus as claimed in claim 1, further comprising:

a display unit configured to display the detection result by the transport status detection unit.

3. The image forming apparatus as claimed in claim 2, wherein the detection result by the transport status detection unit includes a type of a transport error.

4. The image forming apparatus as claimed in claim 1 wherein, if the transport status detection unit detects another delay in transporting said recording sheet or said still another recording sheet during the predetermined period of time during which the transport unit continues transporting said recording medium and said still another recording medium, the control unit controls the transport unit to stop transporting said recording medium and said still another recording medium.

5. The image forming apparatus as claimed in claim 1, wherein the predetermine period of time is a period of time required to discharge said recording medium and said still another recording medium present in the transport path into the container unit.

6. The image forming apparatus as claimed in claim 1, wherein the transport path is circular; and wherein a recording medium reverse unit is disposed on the transport path, the recording medium reverse unit being configured to reverse the recording medium for double-sided printing.

7. The image forming apparatus as claimed in claim 1, wherein a recording medium reverse unit is disposed on the transport path; and wherein the container unit is configured such that the recording medium is discharged into the container unit via the recording medium reverse unit.

8. The image forming apparatus as claimed in claim 7, wherein the container unit is configured such that the recording medium that has passed through the discharge path free-falls into and is held in the container unit.

9. The image forming apparatus as claimed in claim 1, wherein a switching unit configured to switch the transport path of the recording medium is disposed on the transport path; and wherein the control unit controls switching by the switching unit to form a discharge path for the recording medium, the discharge path being different from the transport path.

10. The image forming apparatus as claimed in claim 1, wherein the container unit is formed by processing a casing of the image forming apparatus or the container unit is a tray.

11. The image forming apparatus as claimed in claim 1, wherein the container unit is formed by processing a casing of the image forming apparatus to have a surface inclined relative to a discharge direction such that the discharged recording media are stacked or the container unit is a tray having a surface inclined relative to the discharge direction such that the discharged recording media are arranged in a stack.

12. The image forming apparatus as claimed in claim 1, further comprising:

a recording medium detection unit configured to detect whether one or more of the recording media are held in the container unit; and a reporting unit configured to report, if the recording medium detection unit detects that one or more of the recording media is held in the container unit, that one or more of the recording media is held in the container unit.

13. The image forming apparatus as claimed in claim 1, wherein the control unit includes an error position detection unit configured to detect a position in which a transport error of said recording medium occurs; and wherein a discharge determining unit is provided that is configured to determine a discharge destination to which said still another recording medium in the transport path is to be discharged based on a relationship with the error position detected by the error position detection unit.

14. Image forming apparatus, comprising:

a recording medium feed unit configured to feed a recording medium into a predetermined transport path;

a transport unit configured to transport said recording medium fed by the recording medium feed unit along the transport path;

a transport status detection unit disposed on the transport path and configured to detect a transport status of said recording medium;

a control unit configured to control operations of the recording medium feed unit, the transport unit, and the transport status detection unit; and a container unit configured to hold said recording medium, wherein the control unit controls, according to a detection result by the transport status detection unit, feeding of another recording medium by the recording medium feed unit and transport of said recording medium by the transport unit to discharge said recording medium and still another recording medium present in the transport path into the container unit, if the transport status detection unit detects a delay in transporting the recording medium, the control unit controls the recording medium feed unit to control feeding said another recording medium and controls the transport unit to continue transporting said recording medium and said still another recording medium for a predetermined period of time, if the transport status detection unit detects a delay in transporting the recording medium, the control unit controls the recording medium feed unit to stop feeding said another recording medium and controls the transport unit to continue transporting said recording medium and said still another recording medium for the predetermined period of time, and if the transport status detection unit detects another delay in transporting said recording sheet or said still another recording sheet during the predetermined period of time during which the transport unit continues transporting said recording medium and said still another recording medium, the control unit controls the transport unit to stop transporting said recording medium and said still another recording medium.

* * * * *